United States Patent [19]

Despois et al.

[11] 4,389,673

[45] Jun. 21, 1983

[54] HADAMARD TRANSFORMER USING CHARGE TRANSFER DEVICES

[76] Inventors: Claude Despois, 27, rue Pasteur Bat. B, Appt. 208; Jean-Claude Rebourg, 95, Avenue de la Clairiere, both of 78120 Rambouillet, France

[21] Appl. No.: 242,120

[22] Filed: Mar. 9, 1981

[30] Foreign Application Priority Data

Mar. 11, 1980 [FR] France ..... 80 05406

[51] Int. Cl.[3] ..... H04N 5/14; G06G 7/12

[52] U.S. Cl. ..... 358/160; 358/133; 358/213; 364/515; 364/725; 364/826

[58] Field of Search ..... 358/160, 166, 212, 213, 358/280, 133, 138; 364/515, 725, 826; 370/7; 179/15.55 R

[56] References Cited

U.S. PATENT DOCUMENTS

| | | | |
|---|---|---|---|
| 3,792,355 | 2/1974 | Miyata | 364/725 X |
| 3,976,826 | 8/1976 | Fullton, Jr. | 358/133 |
| 4,055,756 | 10/1977 | Jolivet | 364/725 |
| 4,099,250 | 7/1978 | Finnila et al. | 358/213 X |
| 4,134,134 | 1/1979 | Lux | 358/280 |
| 4,192,004 | 3/1980 | Buerger | 364/518 |
| 4,245,330 | 1/1981 | Rebourg | 358/133 X |
| 4,293,920 | 10/1981 | Merola | 364/725 |

*Primary Examiner*—Robert L. Richardson

*Attorney, Agent, or Firm*—Cushman, Darby & Cushman

[57] ABSTRACT

The Hadamard transformer comprises a charge transfer device having N rest electrodes preceded by N transfer electrodes, 2N reading electrodes, each rest electrode being positioned between a first reading electrode and a second reading electrode and 2N transfer electrodes located between each rest electrode and the associated reading electrodes. The transform also comprises an input circuit able to convert the samples into groups of proportional charges. In addition, it has means for injecting these charge groups beneath the rest electrode. It further comprises a differential charge reader with a positive input and a negative input, the reading electrodes being connected to the positive input and the reading electrodes to the negative input, as well as an output supplying the transformed samples. The transformer also comprises a control circuit having a first output connection connected to the rest electrodes and a second output connection connected to the transfer electrodes.

Application more particularly to the transmission, recording and reproduction of television pictures.

14 Claims, 20 Drawing Figures

φch1
φDS
φch2
φGTLAR
φ3
φch
φ4
φGTh
φ+
φGT1+
φGTS
φ1
φDS
φGT1−
φ−
φGTb
φb'
φDSb
φch'
φb
DS
DSb
GSb
L1+
GTS1
DS1
L1−
GT1+
R1
GT1−
UH
WH
VH
GTLAR
GTSH
DSH
LH+
φGTH+
φGTH−
GTb
GTh
GTH+
RH
GTH−
LH−
U1
W1
V1
LAR2
102
LAR1
102'
LAR3

HADAMARD TRANSFORMER USING CHARGE TRANSFER DEVICES

The present invention relates to a Hadamard transformer using charge transfer devices. It is used more particularly in the transmission, recording and reproduction of television pictures.

The Hadamard transformation (also known under the name Walsh transformation) is a linear transformation defined by a square matrix, whose coefficients are equal to +1 or −1.

More specifically, the Hadamard transformation makes it possible to pass from one sequence of samples designated $X_1 \ldots X_i \ldots X_n$ to a sequence of transformed samples designated $Y_1 \ldots Y_j \ldots Y_n$ by the following linear relation:

$$\begin{bmatrix} Y_1 \\ \cdot \\ Y_j \\ \cdot \\ Y_n \end{bmatrix} = [H] \cdot \begin{bmatrix} X_1 \\ \cdot \\ X_i \\ \cdot \\ X_N \end{bmatrix} \quad (1)$$

in which H is a Hadamard matrix of dimension N.

For example, the transformation operating on sequences of four samples is written:

$$\begin{bmatrix} Y_1 \\ Y_2 \\ Y_3 \\ Y_4 \end{bmatrix} = \begin{bmatrix} +1 & +1 & +1 & +1 \\ +1 & -1 & +1 & -1 \\ +1 & +1 & -1 & -1 \\ +1 & -1 & -1 & +1 \end{bmatrix} \cdot \begin{bmatrix} X_1 \\ X_2 \\ X_3 \\ X_4 \end{bmatrix} \quad (2)$$

which is equivalent to the four following relations:

$$Y_1 = X_1 + X_2 + X_3 + X_4$$

$$Y_2 = X_1 - X_2 + X_3 - X_4$$

$$Y_3 = X_1 + X_2 - X_3 - X_4$$

$$Y_4 = X_1 - X_2 - X_3 + X_4 \quad (3)$$

The Hadamard transformation is of great interest in the processing of television pictures, because it makes it possible to compress the data to be transmitted. In this connection, reference should be made to the article by J. PONCIN entitled "Utilisation de la transformation de Hadamard pour le codage et la compression de signaux d'images" (Use of the Hadamard transformation for the coding and compression of picture signals), published in Annales des Telecommunications, Vol. 26, No. 7–8, July/August 1971, pp. 235 to 252.

Solutions have already been proposed for the construction of devices able to perform such a transformation. They are in particular analog devices with elastic surface waves. In this connection, reference can be made to French Patent application 77.32539 filed on Oct. 24, 1977 and entitled "Hadamard transformers with elastic surface waves".

The disadvantage of these devices is that it is necessary to work on a carrier signal modulated by the image signal, so that it is not directly possible to process the signal to be transformed. This leads to a relatively high level of complexity and also to problems of frequency deviation with temperature.

BRIEF SUMMARY OF THE INVENTION

The present invention relates to a Hadamard transformer not having the aforementioned disadvantage, because it directly processes the signal to be transformed.

To this end, the invention proposes using as the analog device serving as a support for the transformation, a charge transfer device, whose principle is known per se, but in connection with which the invention proposes a new application, together with novel realisation modes.

French Patent application No. 79,12747 filed on May 18, 1979 already describes a Hadamard transformer using charge transfer devices, but they are in a form different from those to be described hereinafter.

It is pointed out that a charge transfer device is a semiconductor circuit in which a group of electrical charges is introduced at one end, then displaced by the group of control voltages to the other end where it is finally collected. Such a device is frequently used as a delay line or filter.

One of the best known charge transfer devices is the charge-coupled device or C.C.D. Such a device comprises a doped semiconductor substrate (p or n) covered by a thin isolating layer (with a thickness of approximately 0.1$\mu$), itself covered by regularly arranged conductive electrodes. Thus, such systems belong to the so-called MIS circuits (Metal-isolator-semiconductor). The stored and displaced charges are constituted by minority carriers held in potential troughs created beneath certain of the electrodes which, to this end, are brought to appropriate potentials. In order to transfer these charges from one electrode to the next, the corresponding potential though is displaced by modifying the voltages applied to the electrodes. The displacement direction can be fixed by any appropriate means: supplementary electrode, doped areas in the substrate, fixed charges, different oxide thicknesses, etc in such a way that the potential troughs have an asymmetrical appearance and transfer takes place in a unidirectional manner.

An input circuit able to produce the charge groups and inject them into the semiconductor substrate is associated with the latter upstream with respect to the charge flow direction, whilst downstream a circuit for the detection of said charges is associated therewith.

For further details on these known devices reference can be made to the article by W. S. BOYLE and G. E. SMITH entitled "Charge coupled semiconductor devices", published in the Journal "The Bell System Technical Journal", April 1970, pp. 587 to 593, as well as the work by Carl H. SEQUIN and Michael F. TOMPSETT entitled "Charge transfer devices" published in 1975 by Academic Press Inc.

The invention proposes the use of this type of device in the following way. An input circuit receives the signal X which has to be processed, transforms it into periodic samples $X_1, X_i \ldots X_n$ (if the input signal has not already been sampled) then converts the value of each sample into a proportional group of electrical charges. The N charge groups representing the N samples $X_1 \ldots, X_i \ldots, X_N$ are then placed beneath N rest electrodes $R_i$.

Each rest electrode $R_i$ is associated with a reading electrode $L_i+$ connected to the positive input of a differential charge reader and to a reading electrode $L_i-$ connected to the negative input of said reader. Each transformed sample is obtained by transferring (by means of transfer electrodes) the charge groups to reading electrodes of appropriate signs. For example, for a rank 4 transformation, as defined by the relations (3), the first reading consists of transferring all the charge groups to reading electrodes $L_i+$ connected to the positive input of the reader. At the reader output, the sample $Y_1$ given by the first of said relations (3) is obtained. The charges read are then brought beneath the rest electrodes $R_i$. The second reading consists of again transferring the charge groups beneath the reading electrodes, which are respectively negative, positive and negative and at the output of the reader, sample $Y_2$ is obtained, which is given by the second of the relations (3). The charges are then brought beneath the rest electrodes and so on.

In general manner, in order to obtain a transformed sample of rank j in a transformation of dimension N, the charged representing the samples $X_1 \ldots X_i \ldots X_N$ are transferred beneath reading electrodes $L_i+$ or $L_i-$ in such a way that the sequence of N signs of these electrodes corresponds to the sequence of the N signs of the $j^{th}$ line of the Hadamard matrix. At the reader output, we then obtain a signal equal to:

$$Y_j = \sum_i a_{ij} X_i$$

in which $a_{ij}$ are N coefficients of the $j^{th}$ line of the Hadamard matrix of rank N. The N charge groups are then brought under the rest electrodes. Naturally, when the final transformed sample has been obtained, the charges are dissipated by appropriate means and a new group of N input samples can be processed.

More specifically, the invention relates to a Hadamard transformer which makes a group of N transformed samples $Y_1 \ldots Y_j \ldots Y_N$ correspond to a group of given samples $X_1 \ldots X_i \ldots X_N$, each having transformed sample being defined by a weighted sum of N given samples, the weighting coefficients being equal to +1 and −1, wherein it comprises:

(A) a charge transfer device incorporating:

(a) N rest electrodes $R_1 \ldots R_i \ldots R_N$ preceded by N transfer electrodes $R_1' \ldots R_i' \ldots R_N'$ (b) 2 N reading electrodes, which rest electrode $R_i$ being positioned between a first reading electrode $L_i+$ and a second reading electrode $L_i-$, (c) 2 N transfer electrodes $GT_i+$ and $GT_i-$ positioned between each rest electrode $R_i$ and the associated reading electrodes $L_i+$ and $L_i-$;

(B) an input circuit able to convert the samples $X_1 \ldots Xi \ldots X_N$ into proportional charge groups; (C) a means for injecting these charge groups beneath the rest electrodes in such a way that the changes corresponding to the samples $X_1 \ldots X_i \ldots X_N$ are respectively positioned beneath the electrodes $R_1 \ldots R_i \ldots R_N$ (D) a differential charge reader with two inputs, on e positive and the other negative, the reading electrode $L_i+$ being connected to the positive input and the reading electrode $L_i-$ to the negative input and to an output supplying the transformed samples $Y_1 \ldots Y_j \ldots Y_N$;

(E) a control circuit having a first output connection connected to the rest electrodes $R_i$ and carrying a signal $\phi_1$ and a second output connection connected to the transfer electrodes $R_i$ and carrying a signal $\phi_2$ in phase opposition to $\phi_1$, a first group of N output connections connected to the N transfer electrodes $GT_i+$ and carrying signals $\phi GT_i+$ and a second group of N output connections connected to the N transfer electrode $GT_i-$ and carrying signals $\phi GT_i-$, said signals $\phi_1$, $\phi_2$, $\phi GT_i+$ and $\phi GT_i-$ being able to firstly control the transfer of charges positioned beneath each rest electrode to one of the two associated reading electrodes, then the return of these charges to said rest electrodes, this taking place N times to obtain the N transformed samples.

BRIEF DESCRIPTION OF THE DRAWINGS

The invention is described in greater detail hereinafter relative to non-limitative embodiments and with reference to the attached drawings, wherein show.

DETAILED DESCRIPTION OF THE PREFERRED EMBODIMENTS

Figure 1:
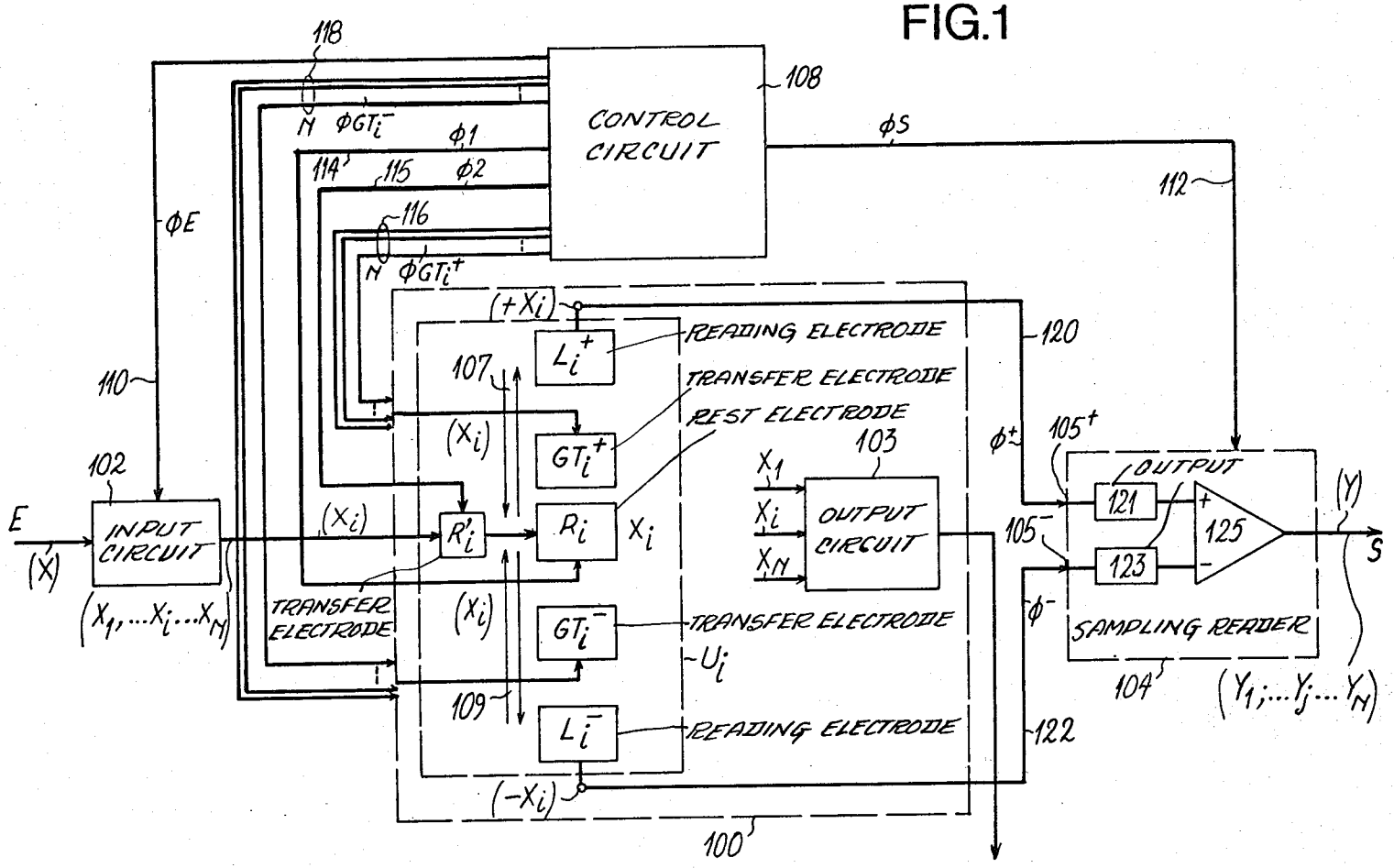
FIG. 1 the block diagram of the device according to the invention.

The device diagrammatically shown in FIG. 1 comprises a charge transfer device 100, provided with an output circuit 103, an input circuit 102 with one input E which receives the signal X and one output which supplies the samples $X_1 \ldots X_i \ldots X_N$, a differential sampling reader 104 with one positive input 105+ and one negative input 105[31] and an output S and a circuit 108 for the control of the input circuit 102, the charge transfer device 100 and a differential reader 104.

The charge transfer device 100 comprises a plurality of processing units $U_i$ ($U_i$ varying from 1 to N), each of which has a rest electrode $R_i$ preceded by a transfer electrode $R_1'$, two reading electrodes $L_i+$ and $L_i-$ respectively connected to the positive input 105+ and the negative input 105− of reader 104 and two transfer electrodes $GT_i+$ and $GT_i-$ positioned between the rest electrode $R_i$ and the reading electrodes $L_i+$ and $L_i-$.

The output circuit 103 can be formed by a polarized diode associated with a control grid.

The differential reader 104 comprises two charge measuring circuits 121 and 123 and a differential amplifier 125 with two inputs, the one being reversing and the other not. The measuring circuits 121 and 123 operate under current or under voltage.

The control circuit 108 has a certain number of output connections:

a connection 110 carrying a signal $\phi E$ controlling the sampling of the input signal in circuit 102;

a connection 112 carrying a signal $\phi S$ controlling the sampling of the output signals in reader 104;

a connection 114 connected to all the rest electrodes $R_i$ and carrying a signal $\phi_1$;

a connection 115 connected to all the transfer electrodes $R_i'$ and carrying a signal $\phi_2''$ in phase opposition with $\phi_1$;

a first group 116 of N connections connected to N transfer electrodes $GT_i+$;

a second group 118 with N connections connected to N transfer electrodes $GT_i-$.

Moreover, the charge transfer device 110 has two output connections, one 120 connecting all the leading electrodes $L_i+$ to the positive input 105+ of reader 104, said connection carrying a signal $\phi+$, whilst the other 122 connects all the reading electrodes $L_i+$ to the negative input 105− of the same reader, said connection carrying a signal $\phi-$.

The structure of circuits 102, 103, 104 and 108 is known and is more particularly described in the work referred to hereinbefore. Therefore, no detailed description will be provided hereinafter.

The device shown in FIG. 1 largely functions in the following manner. The samples $X_1 \ldots X_i \ldots X_N$ are firstly placed under the rest electrodes $R_1 \ldots R_i \ldots R_N$ by appropriate means, whereof certain embodiments will be described hereinafter. Each sample $X_i$ is then transferred either to electrode $L_i+$ or to electrode $L_i-$, depending on whether the weighting coefficient of $X_i$ in the expression of the transformed sample to be calculated is equal to +1 or −1. These transfers are authorized by electrodes $GT_i+$ and $GT_i-$. Connection 120 makes it possible to read all the groups of charges transferred beneath electrode $L_i+$ and connection 122 all the groups of charges transferred beneath electrode $L_i-$. The differential reader then supplies at its output the transformed sample $Y_j$. The charges are then retransferred beneath rest electrodes $R_i$ via transfer electrodes $GT_i$. The double arrows 107–109 indicate the double charge transfer during one reading operation.

It is obvious that FIG. 1 is only a general diagram illustrating the general organisation of the transformer according to the invention. The variants to be described in conjunction with the following drawings all have this general organisation. They differ from one another in the way in which the processing units $U_i$ are realised and the way in which the different units are assembled with one another.

In the following description, it is assumed that the charge transfer devices are of the CCD type with two electrode levels. The electrodes of the second level are shown in hatched form on the drawings. These electrodes are sometimes connected to the electrodes of the first level, in which case a directional transfer is obtained.

For the description of the operation of these various devices, it is also assumed that the charge transfer devices are of the CCD type with channel N. The control voltages are then positive. The devices also with channel P are immediately deduced therefrom and the control voltages then have the reverse polarity. In the case of channel N CCD for an electrode to be active or conductive, it is necessary to apply thereto a positive voltage and for it to be blocked, it is merely necessary that its control voltage is zero.

Finally and for simplifying the description, a limitation will be made to the case of transformers functioning on groups of four samples, in other words Hadamard matrixes of dimension 4. However, a direct extension to more complex transformers is possible. Thus, it is known that if H is a Hadamard matrix of dimension N, the matrix:

$$G = \begin{bmatrix} H & H \\ H & -H \end{bmatrix}$$

is then a Hadamard matrix, but of dimension 2 N.

Thus, on the basis of the matrix of dimension 4 given by the relation 2, it is possible to successively produce matrixes of dimensions 8, 16 . . . $2^n$ and in the same way to find the corresponding transformers.

More generally, it is possible to produce from a Hadamard matrix of dimension $2^K$ a Hadamard matrix of dimensions $2^L \times 2^K$, K and L being integers and thus produce a device making it possible to pass from a transformation of order 2K to a transformation of order $2^{K+L}$.

Thus, one of the properties of the Hadamard matrixes is to be able to break down into products having two more simple matrixes. For example, a matrix A representing a rank4 transformation can be broken down into a product with two matrixes B, C as follows:

$$\begin{bmatrix} + & + & + & + \\ + & - & + & - \\ + & + & - & - \\ + & - & - & + \end{bmatrix} = \begin{bmatrix} + & 0 & + & 0 \\ 0 & + & 0 & + \\ + & 0 & - & 0 \\ 0 & + & 0 & - \end{bmatrix} \begin{bmatrix} + & + & 0 & 0 \\ + & - & 0 & 0 \\ 0 & 0 & + & + \\ 0 & 0 & + & - \end{bmatrix}$$

$$[A] = [B] \times [C]$$

Matrix C is formed by two submatrixes of dimension 2. It is possible to differently regroup the lines of matrix B and consider a matrix B':

$$\begin{bmatrix} + & 0 & + & 0 \\ + & 0 & - & 0 \\ 0 & + & 0 & + \\ 0 & + & 0 & - \end{bmatrix}$$

On forming the product of matrixes B' and C we obtain a matrix A':

$$A' = \begin{bmatrix} + & + & + & + \\ + & + & - & - \\ + & - & + & - \\ + & - & - & + \end{bmatrix}$$

This matrix A' is an orthogonal matrix and also a Hadamard matrix.

The advantage of matrix B' compared with that of B is that it is easily possible to put it into concrete form by a circuit making it possible to realise the linear transformation which it represents, as will be seen hereinafter. Matrix C corresponds to a Hadamard transformer of dimension $2^K$. The device corresponding to matrix B' then makes it possible to pass from a $2^K$ transformation to a $2^{K+L}$ transformation.

Figure 2:
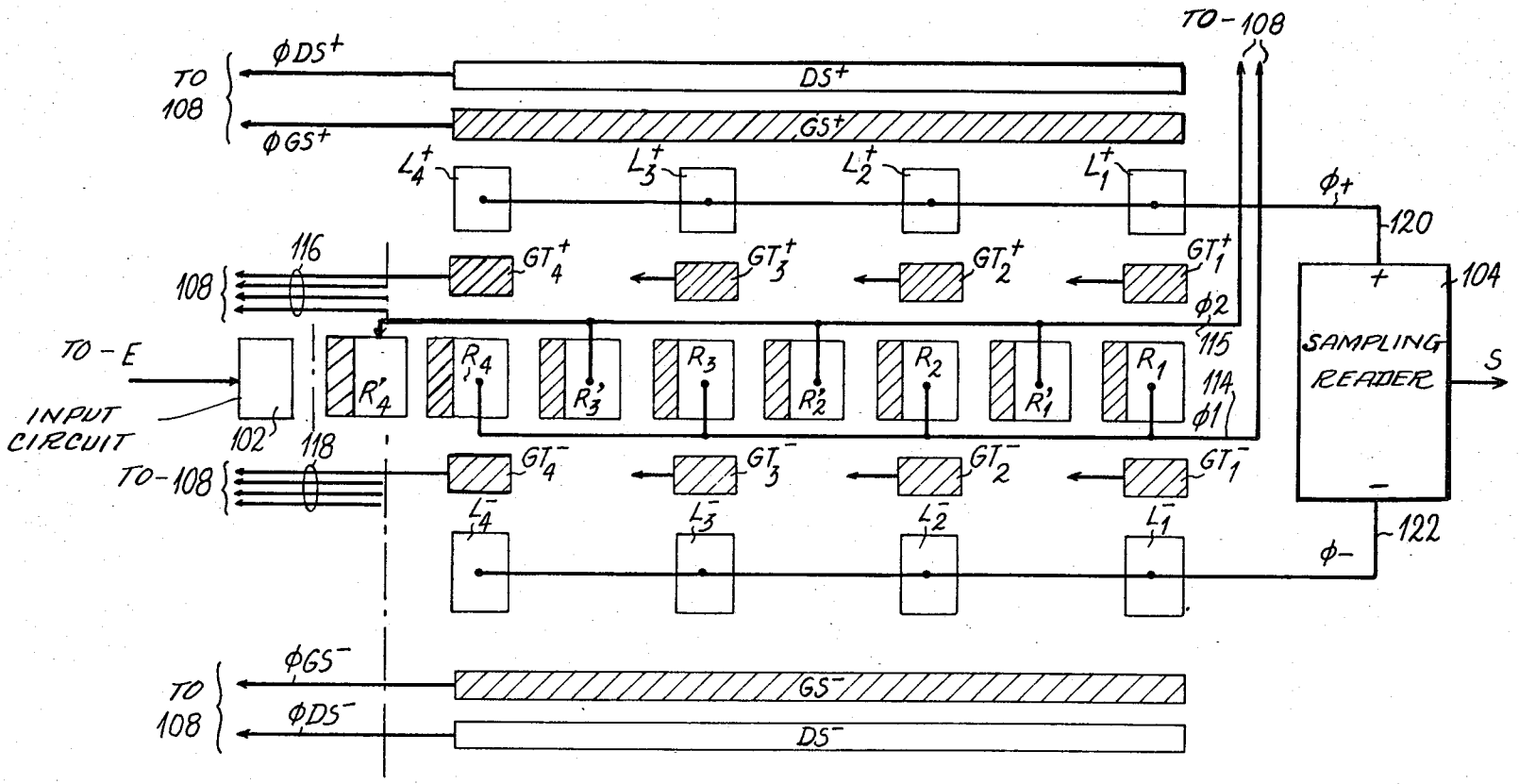
FIG. 2 a first embodiment of a four-point transformer with aligned rest electrodes.

In the embodiment illustrated in FIG. 2, the four rest diodes $R_1$, $R_2$, $R_3$ and $R_4$ are aligned and preceded by four transfer electrodes $R_1'$, $R_2'$, $R_3'$ and $R_4'$. The former are controlled by the signal $\phi_1$ carried by connection 114 and the latter by a signal $\phi_2$ carried by a connection 115 connected to control circuit 108. The reading electrodes ($L_1+$, $L_2+$, $L_3+$, $L_4+$) and ($L_1-$, $L_2-$, $L_3-$, $L_4-$) are distributed on either side of the rest electrodes and are separated therefrom by transfer grids respectively ($GT_1+$, $GT_2+$, $GT_3+$, $GT_4+$) and ($GT_1-$, $GT_2-$, $GT_3-$, $GT_4-$).

The positive reading electrodes are bordered by an output grid $GS_+$ associated with an output diode GS+ and the negative electrodes by an output grid GS− associated with an output diode DS−. The grids GS+ and GS− are controlled by signals $\phi$GS+ and $\phi$GS− supplied by circuit 108. Diodes DS+ and DS− are controlled by signals $\phi$DS+ and $\phi$DS−.

Figure 3:
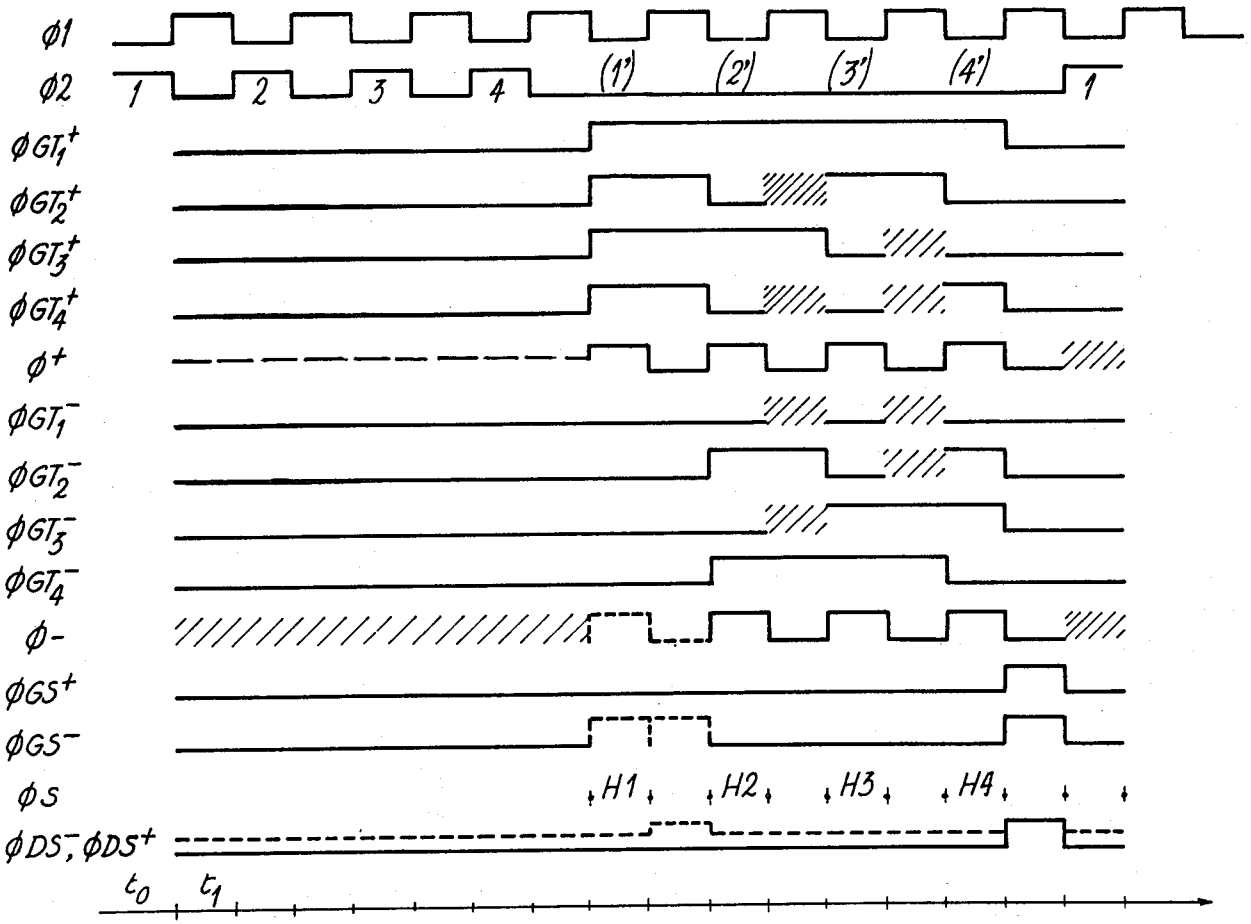
FIG. 3 a chronogram illustrating the operating principle of the aforementioned transformer.

The chronogram of FIG. 3 represents the evolution of the different control signals used and illustrates of the operation of the device of FIG. 2.

The signal to be processed is applied to the input circuit 102, which transforms it into groups of charges, successively $X_1$,$X_2$,$X_3$,$X_4$,etc. The transfer electrodes GT are all brought to a potential by the voltages, which are all zero. Four pulses in phase oppositions $\phi_1$ and $\phi_2$ are applied to the electrodes $R_1$ to $R_4$ of the central row. As a result, the samples advance in said row and after four clock periods sample $X_1$ is located beneath $R_1$, $X_2$ beneath $R_2$, $X_3$ beneath $R_3$ and $X_4$ beneath $R_4$. It is then possible to start the calculation of the transform.

Throughout the calculation, the electrodes connected to $\phi_2$ remain blocked, electrodes $GT_1+$, $GT_2+$, $GT_3+$ and $GT_4+$ being firstly unblocked, i.e. brought to a positive voltage. The signals $\phi+$ and $\phi-$ are also brought to a positive value. The charges are all transferred beneath the reading electrode $L_i+$, and, at the output of the read-out circuit, the first component of the transform is obtained. Immediately thereafter, the voltages $\phi+$ and $\phi-$ are brought to a zero value, whilst the electrodes $R_1$ to $R_4$ become positive. The charges $X_1$ to $X_4$ are respectively returned beneath electrodes $R_1$ to $R_4$.

The control voltages of electrodes $R_1$ to $R_4$, as well as $\phi+$ and $\phi-$ are then reversed, whilst the control electrodes $GT_1+$, $GT_2-$, $GT_3+$, $GT_4-$ are made conductive by applying voltages and electrodes $GT_1-$, $GT_2+$, $GT_3-$ and $GT_4+$ are blocked by applying zero voltages. The charge is then passed beneath the reading electrodes $L_1+$, $L_2-$, $L_3+$, $L_4-$ and the second component of the transform is obtained at the output of the reading circuit. The transfer electrodes retain their voltages, electrodes $R_1$ to $R_4$ become positive again and the reading electrodes become negative. The charge is returned to electrodes $R_1$ to $R_4$ again.

It is then the transfer electrodes $GT_1+$, $GT_2-$, $GT_3-$, $GT_4-$ which become conductive, because the others are blocked. The charges then leave electrodes $R_1$ to $R_4$ to pass beneath the reading electrodes $L_1+$, $L_2+$, $L_3-$ and $L_4-$ and the third component of the transform is obtained. Immediately thereafter, a polarity reversal of the reading electrodes and rest electrodes return the charges beneath the latter.

Finally, electrodes $GT_1+$, $GT_2-$, $GT_3-$ and $GT_4+$ become positive and the fourth and last component of the transform is obtained.

Immediately thereafter, all the transfer electrodes are blocked and electrodes GS+ and GS− are made conductive. All the charges are dissipated in the output diodes DS+ and DS−.

The circuit is then ready to take the following group of four samples and calculate the four transformed samples corresponding thereto in the same way.

The description provided hereinbefore applies in the case where the input signal always has the same polarity, e.g. is always positive. If this is not the case a difficulty is encountered due to the fact that the device can only function with charges having a given polarity. C is the maximum number of charges (depending on the dimensions and construction technology of the device ) which can be processed by a given CTD. If with such a CTD it is desired to transmit signals or samples which are both positive and negative, it is necessary to agree that a number of charges close to C/2 corresponds to a zero signal, which can be increased or decreased by a number of charges proportional to the instantaneous value of the signal. Polarization charges can also be superimposed on the signal, said polarization corresponding to the number C/2 of transmitted charges. Thus, in the proposed transformers, it is necessary that at each time where an output signal is supplied, the number of polarized electrodes connected to the positive input of the reading device must be equal to the number of polarized electrodes connected to the negative input, in order that there is a balance between the contributions of the polarization charges. If this is not the case, auxiliary balancing electrodes must be provided.

It will be seen that the read-out circuit balances the polarization charges for all the components of the Hadamard transform (having the same number of +1 coefficients as −1 coefficients), except for the first where all the coefficients are equal to 30 1. In order also to obtain balancing for this component it is necessary to provide a separate circuit. One solution consists of using the diode DS− and the electrode GS− for introducing beneath the negative reading electrodes the charges necessary for balancing at the moment of calculating the first component and then immediately thereafter displacing them to the diode DS−.

Figure 4:
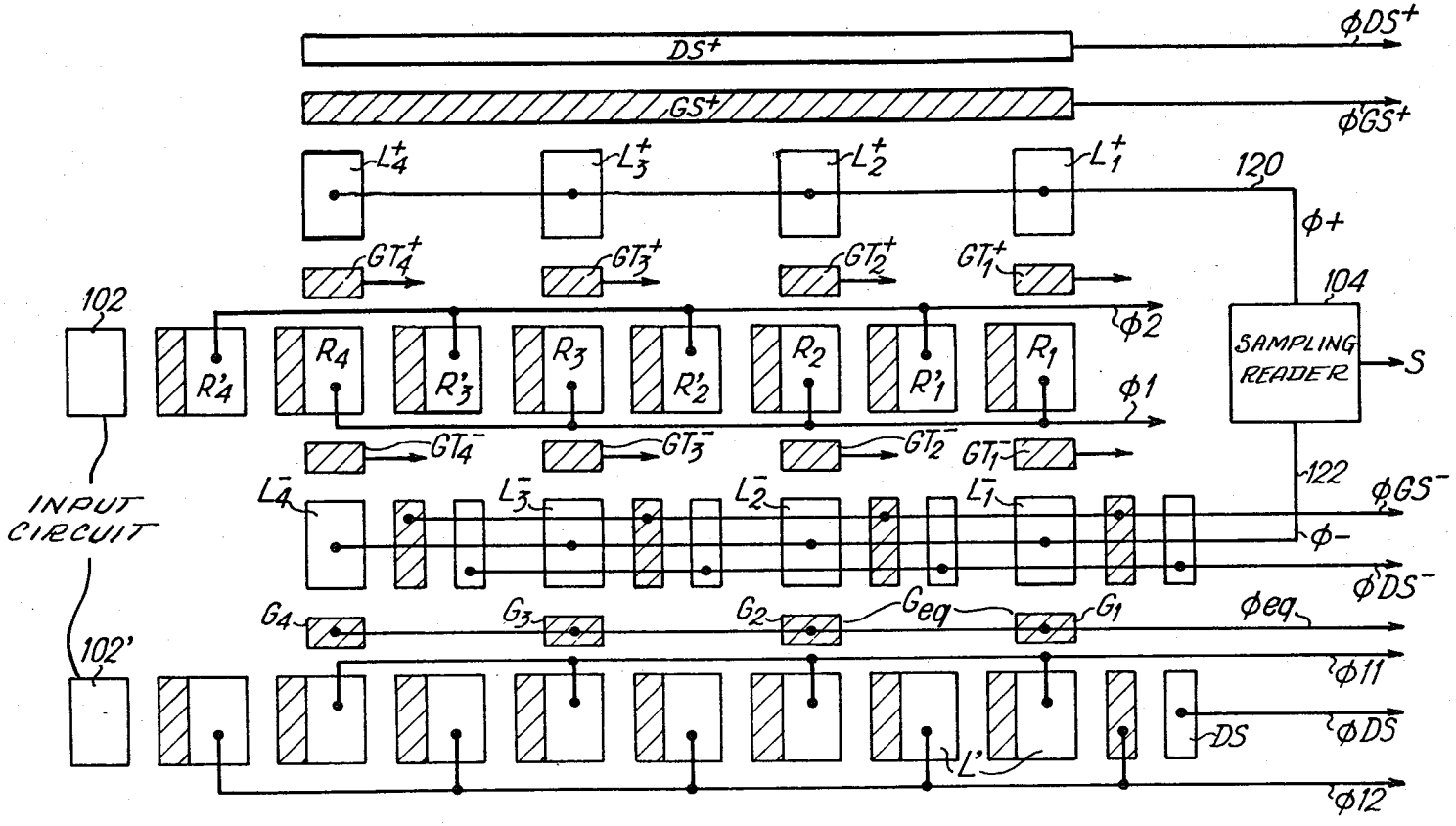
FIG. 4 a variant of the first embodiment.
Figure 5:
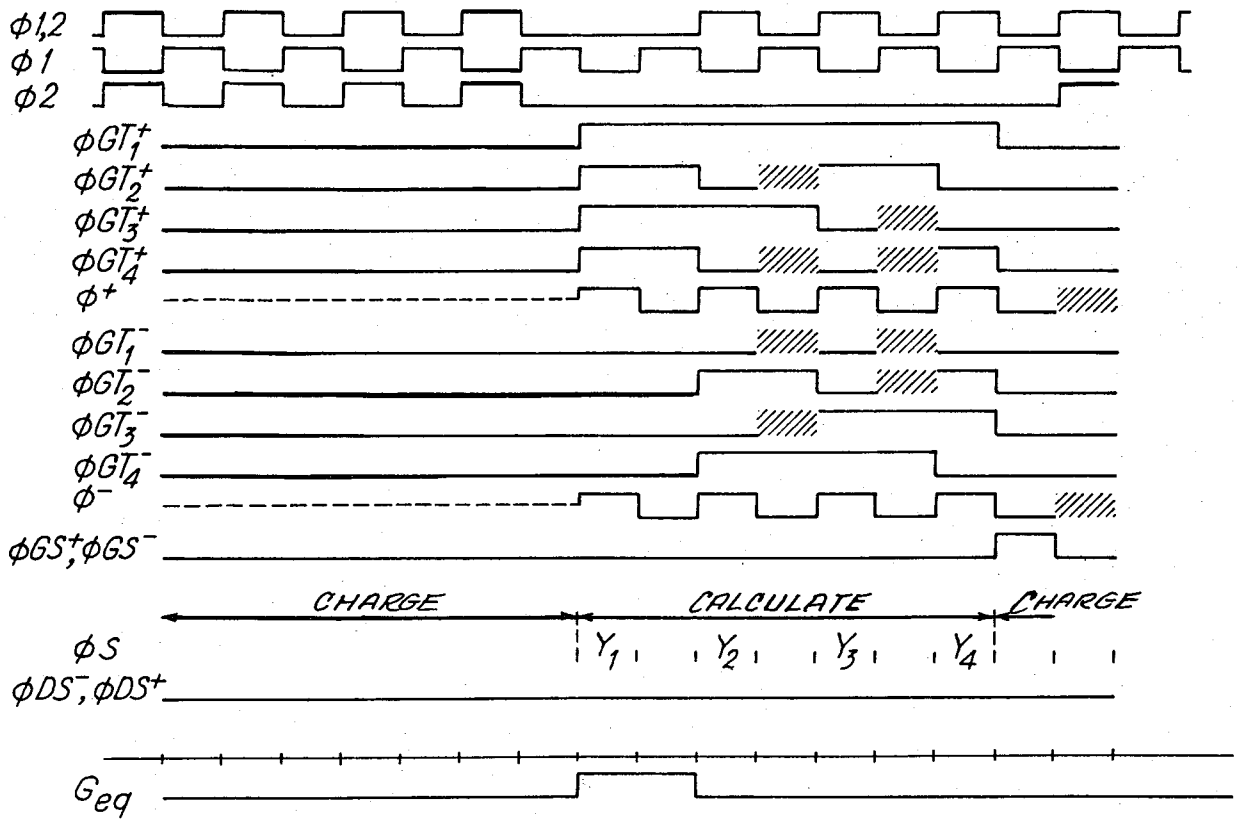
FIG. 5 a chronogram illustrating the operating principle of the variant.

Another solution consists of replacing, for balancing purposes, the output diode DS− by a balancing delay line $LR_{eq}$ and grid GS− by electrodes $G_1$,$G_2$, $G_3$,$G_4$. The delay line is controlled by signals $\phi_{11}$ and $\phi_{12}$ and electrodes $G_{1,2,3,4}$ by a signal $\phi_{eq}$ controlling the balancing. The input circuit of the balancing delay line can then be more elaborate and consequently more linear. The corresponding structure is shown in FIG. 4 and the corresponding time diagram in FIG. 5. The balancing charges are introduced by the input circuit into the balancing delay line $LR_{eq}$ in synchronism with the introduction of the signal into the central row ($R_i$, $R_i'$). At the time of calculating $y_1$, the electrodes $G_1$,$G_2$, $G_3$ and $G_4$ are then conductive, whilst group $\phi_{12}$ is blocked. The balancing charges are therefore directed towards the negative reading electrodes from where the balancing is sought. Immediately thereafter as $\phi^-$ is brought to earth and $\phi_{11}$ becomes positive, the balancing charges return to the lower line and the transfer in this line continues during the calculation in the direction of output diode DS. At the end of the calculation of the transform, the charges corresponding to the samples are dissipated in DS+ and DS− by unblocking $\phi$GS+ and $\phi$GS− and the described cycle recommences. In the device, due to the presence of $LR_{eq}$, DS− and GS− are arranged laterally with respect to electrodes $L_i$−.

Figure 6:
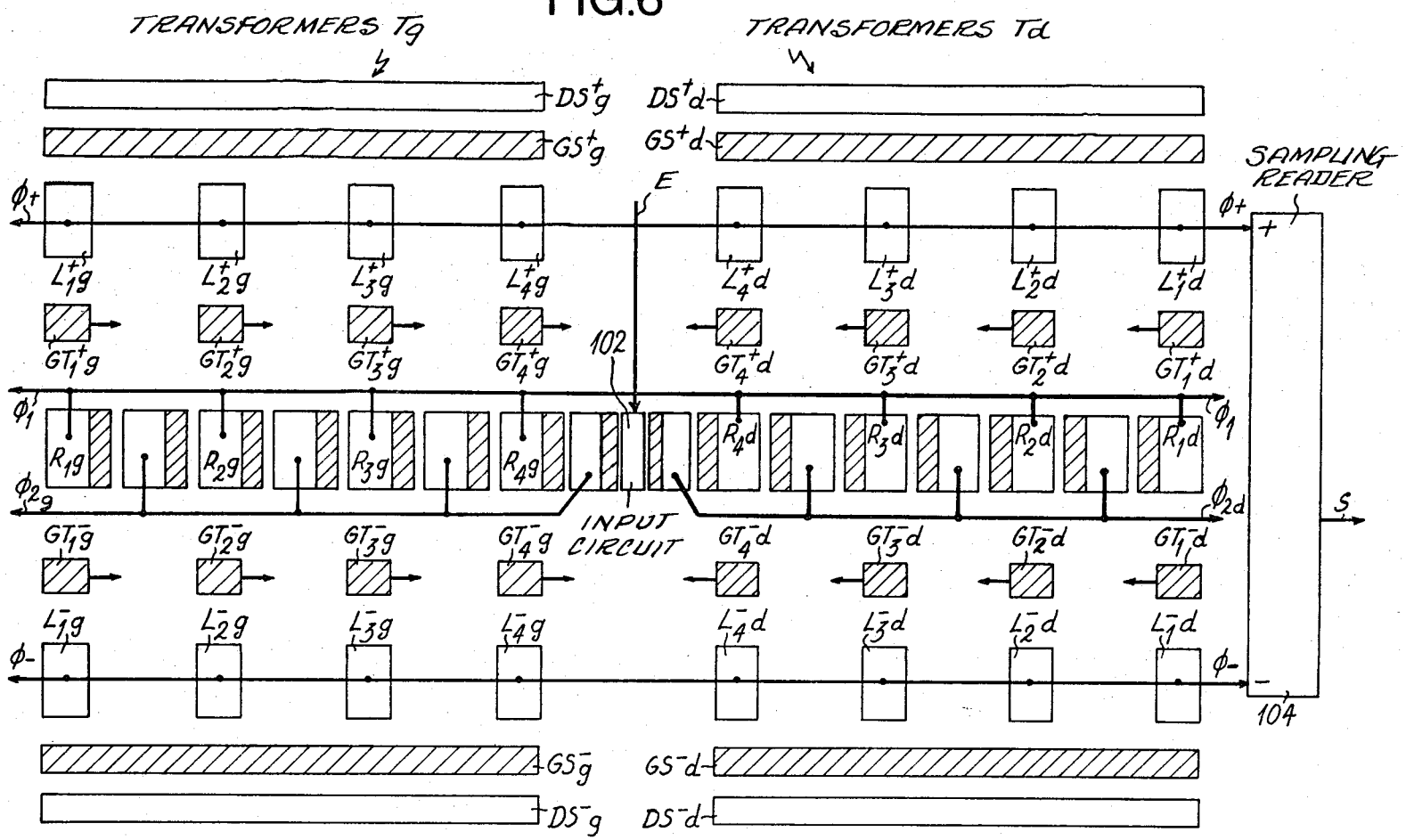
FIG. 6 an embodiment of a four-point transformer in which two transformers are arranged in parallel with the same input circuit.
Figure 7:
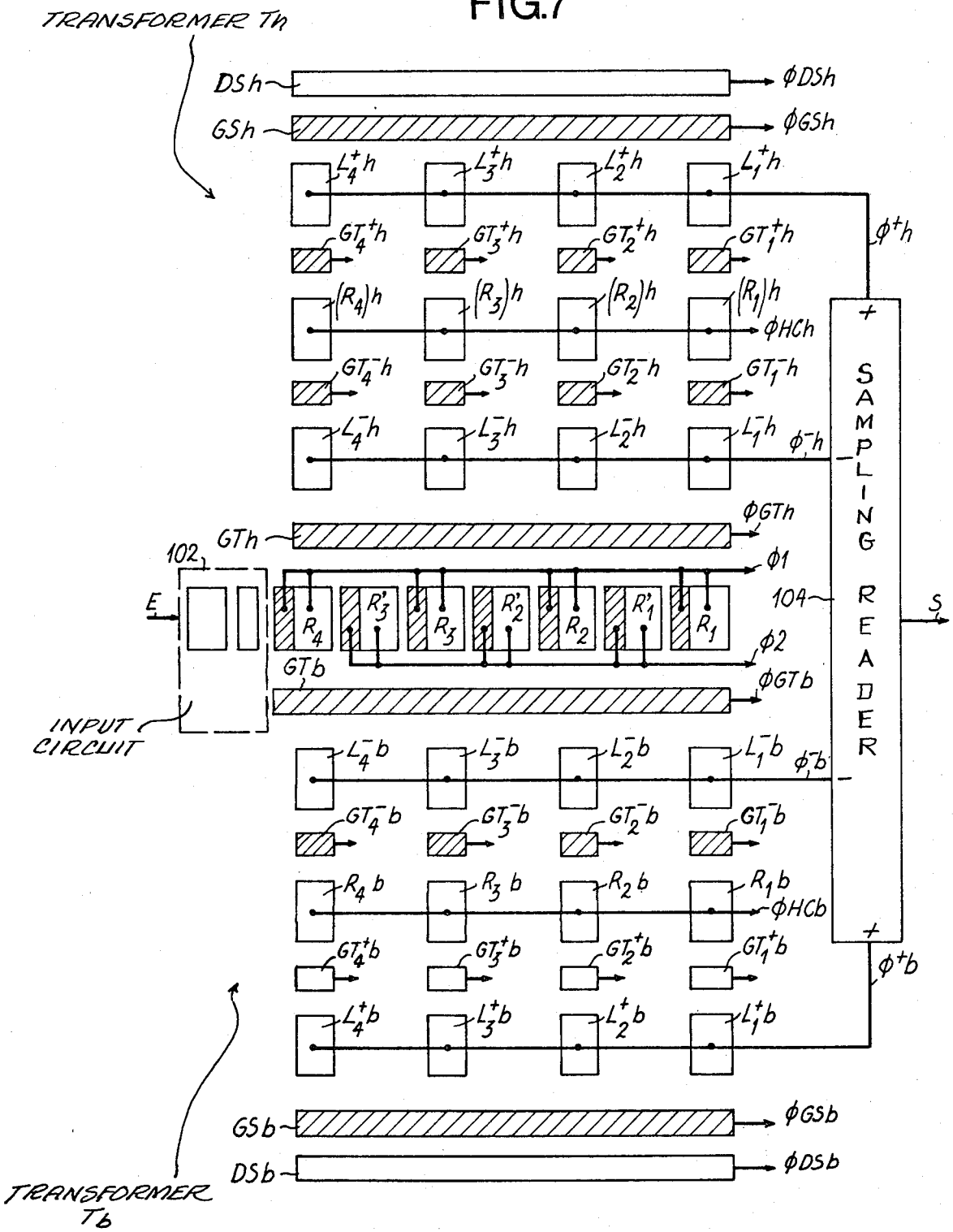
FIG. 7 another embodiment using two transformers in parallel with a row of common rest electrodes.

The above description shows that the device can only calculate the transform of a group of samples when all these samples have been transferred beneath the rest electrodes $R_i$ and cannot receive further direct samples during the calculation operations corresponding to this group. The end of the calculation must be awaited before starting with another group. Thus, the device can only process every other sample group. For continuous working to take place, it is necessary to use two alternately operating, identical devices. FIGS. 6 and 7 show two variants of double devices.

The device of FIG. 6 comprises two identical transformers Td and Tg having a common input circuit 102 and a common differential reader 104. Each of the transformers is identical to that of FIG. 2, their components carrying the same references followed by the reference letters d and g (for right and left respectively).

The two chronograms illustrating the operation of this device are identical to that for FIG. 3. One of them is displaced by four pulses in such a way that the groups of four samples are alternately directed towards Td and Tg. The signal $\phi_1$ can be common to the two transformers and the signal $\phi_{2d}$ and $\phi_g$ displaced.

A second embodiment of the double device is shown in FIG. 7 and comprises two identical transformers Th and Tb of the same construction as the transformer of FIG. 2. Their components carry the same references as in FIG. 2, but also carry a letter h or b (for top and bottom respectively). These two transformers have a common input circuit 102 and common output circuit 104 and surround a central delay line constituted by a row of rest electrodes $R_1$,$R_2$,$R_3$ and $R_4$ controlled by signals $\phi_1$ and separated by transfer electrodes $R_1'$, $R_2'$ and $R_3'$ controlled by a signal $\phi_2$. This central row is driven by the input circuit 102.

This device also comprises two transfer electrodes GTh and GTb connecting transformers Th and Tb to the central delay line. These electrodes are controlled by signals $\phi$GTh and $\phi$GTb.

Figure 8A:
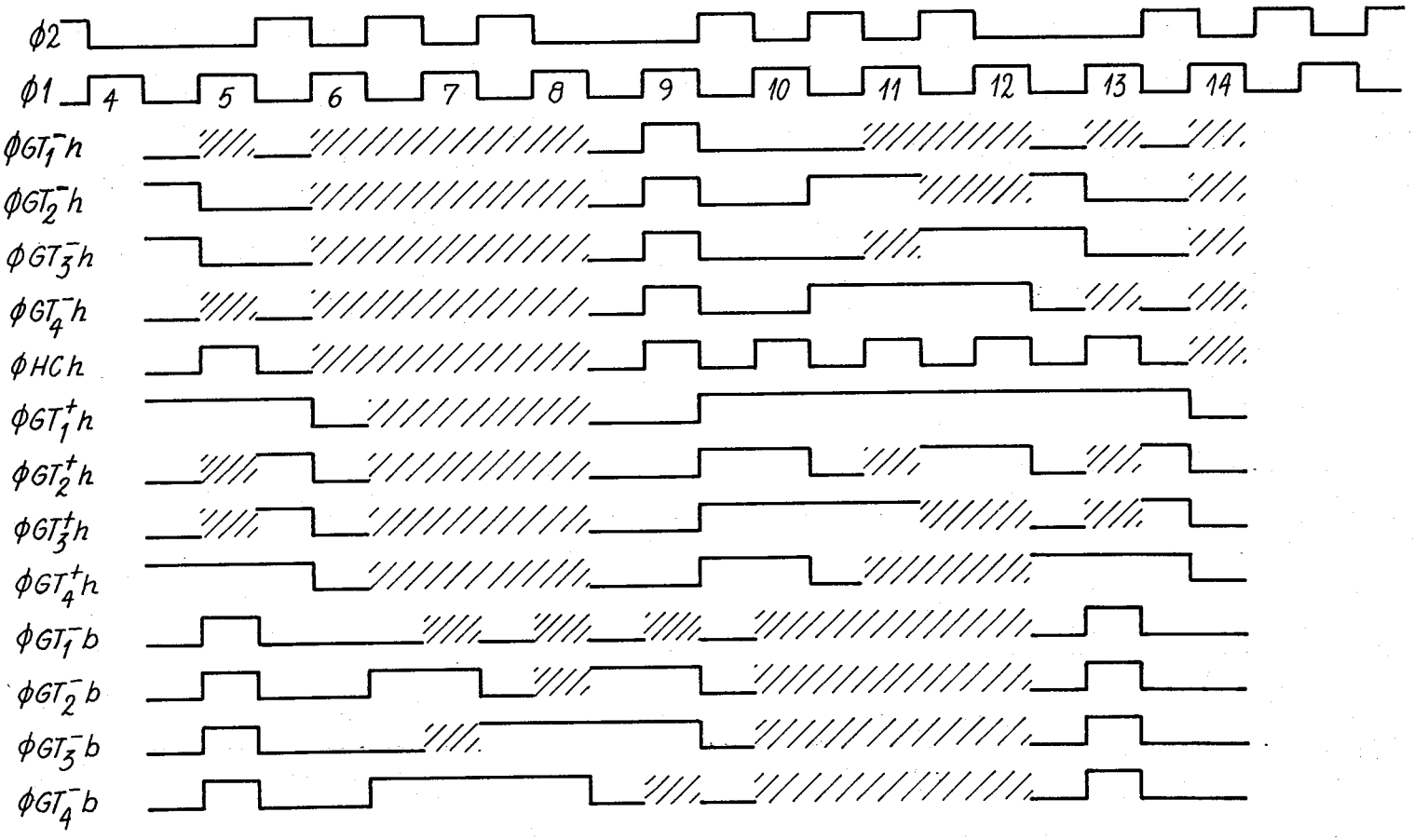
FIGS. 8A and 8B, chronograms illustrating the operation of the device of FIG. 7.
Figure 8B:
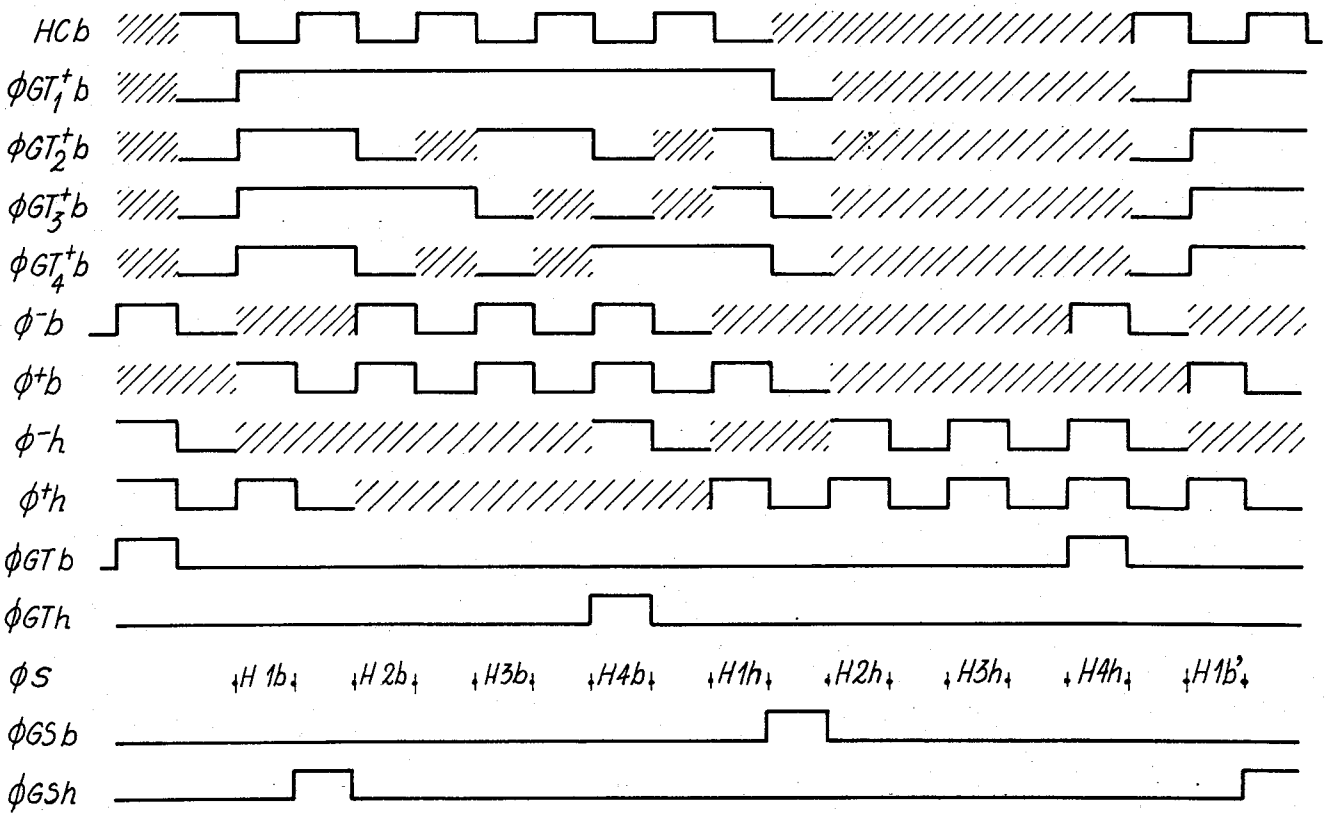

The operation of this device is illustrated by the chronogram of FIG. 8 (divided up into 8A and 8B). The central delay line is firstly charged by four samples. It is then discharged towards transformer Th across electrode GTh which, for this purpose, is raised to a positive voltage. Transformer Th then calculates the first four components of the transform. During this calculation, the central line is recharged by the four following samples. It is then discharged to transformer Tb, which then calculates the four new samples and so on. At the end of the calculation of each group of four samples, the charges are again directed across the grids respectively GSh and GSb to diodes DSh and DSb where they are dissipated, so that transformers Tb and Th are made available for a further processing operation.

The balancing means of this device can also be deduced from the solutions proposed in FIGS. 2 and 4. It should be noted in this connection that the reading electrode lines can be inverted (positive electrodes along the central row and instead of being at the periphery), the illustrated arrangement only being given in an exemplified manner.

Figure 9:
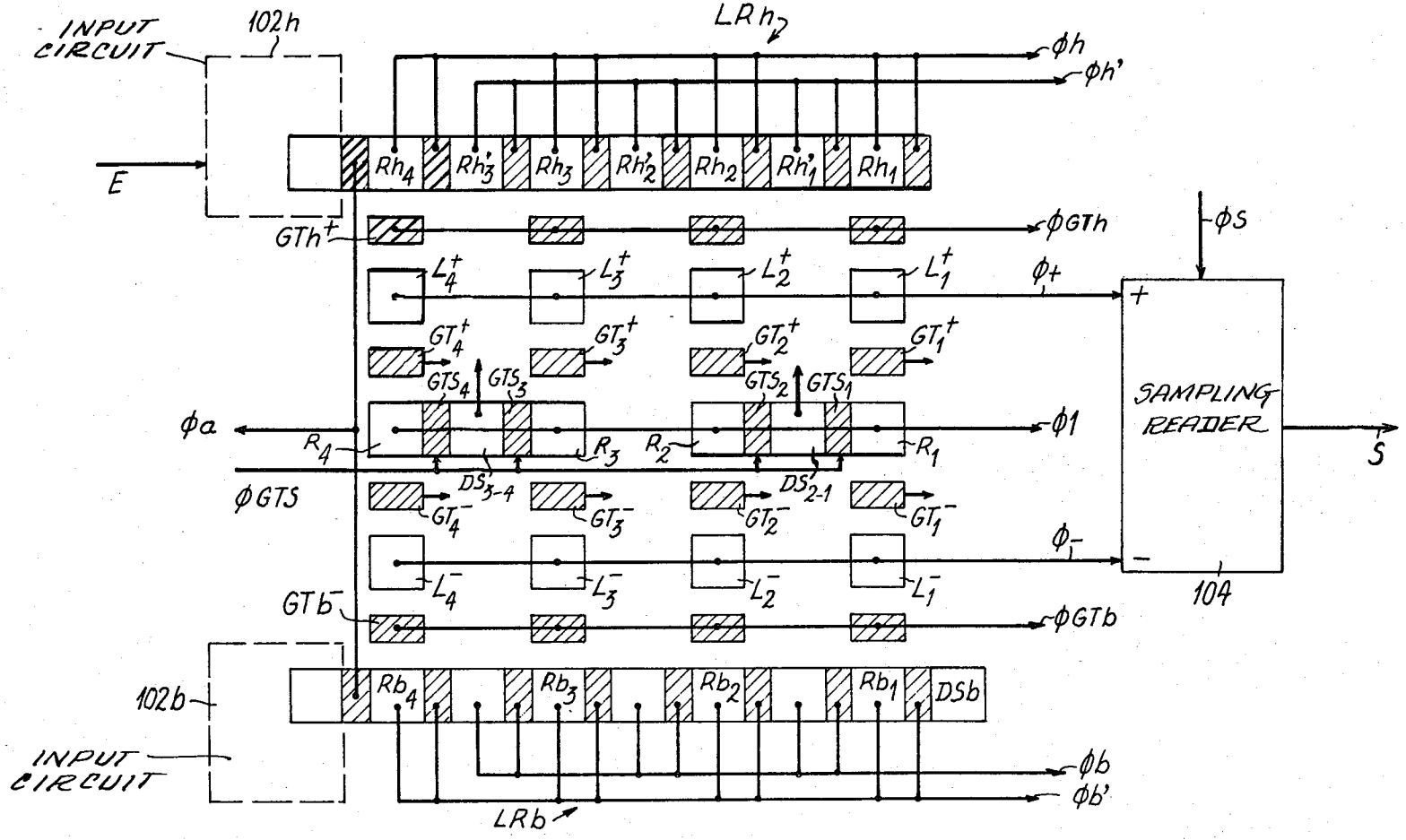
FIG. 9 another variant with two transformers in parallel.

The two variants described hereinbefore use two transformers and a delay line. The variant which will now be described uses a single transformer, but two delay lines. The corresponding structure is shown in FIG. 9. Two delay lines LRh and LRb with seven electrodes are supplied by input circuits **102*h* and 102*b* and are connected to a Hadamard transformer by two lines of transfer electrodes GTh+ and GTb− controlled by signals $\phi$GTh+ and $\phi$GTb−. The delay line LRh comprises electrodes at two levels $RH_1$ to $Rh_4$ controlled by a signal $\phi$h and interposed electrodes $Rh_1'$ to $Rh_3'$ controlled by a signal $\phi$h' in opposition with $\phi$h. In the same way, delay line LRb comprises electrodes with two levels $Rb_1$ to $Rb_4$ controlled by a signal $\phi$b and interposed electrodes $Rb_1'$ to $Rb_3'$ controlled by a signal $\phi$b' in opposition with $\phi$b. The rest electrodes $R_1$ to $R_4$ of the actual transformer are controlled by signals $\phi_1$ and are provided with transfer grids $GTS_1$ to $GTS_4$, which give access to the two output diodes $DS_{2\text{-}1}$ and $DS_{3\text{-}4}$. Moreover, the input circuits 102*h* and 102*b*** are controlled by a signal $\phi$a. Finally, the delay line LRb is associated with an output diode DSb.

Figure 10:
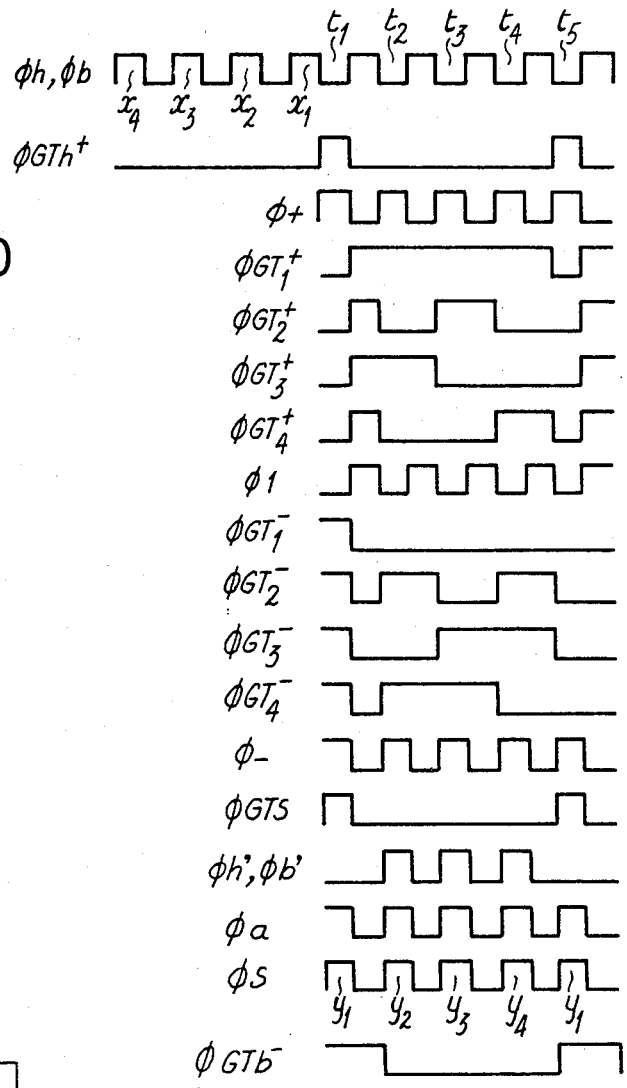
FIG. 10 a chronogram illustrating the operation of the device of FIG. 9.

The operation of this device is illustrated by the chronogram of FIG. 10. The upper delay line LRh serves to introduce the input samples. The lower delay line LRb merely serves to compensate the polarization of the device or to ensure that a zero input signal corresponds to a zero output signal.

The samples $X_1$ to $X_4$ of the input signal are introduced into the delay line LRh and after four pulses of $\phi$h and $\phi$h', $X_1$ is located beneath $Rh_1$, $X_2$ beneath $Rh_2$, $X_3$ beneath $Rh_3$ and $X_4$ beneath $Rh_4$. The signal $\phi$h' is the kept blocked, as is $\phi$a. $\phi$GTh+ is then polarized. Due to the unidirectionality of the delay line (electrodes with two levels) the charges can only pass beneath the positive reading electrodes $L_i$+ controlled by $\phi^+$. At time $t_1$, a signal proportional to $X_1+X_2+X_3+X_4$ is obtained at output S, i.e. the first component $Y_1$ of the transform. The grids $GT_i$+ are then made conductive and the transfer electrodes GTh+ are blocked. $\phi^+$ is then brought to earth and $\phi_1$ is polarized. The charges are then passed to the rest electrodes $R_1$ to $R_4$.

At $t_2$, $\phi_1$ is brought to earth, whilst electrodes $GT_1$+, $GT_2$−, $GT_3$+, $GT_4$− are made conductive, the other grids $GT_i$ being blocked. The groups of charges are then respectively transferred beneath electrodes $L_1$+, $L_2$−, $L_3$+, $L_4$−. $\phi^+$ and $\phi^-$, are polarized so that at output S a signal $Y_2=X_1-X_2=X_3-X_4$, i.e. the second sample. $\phi_1$ then becomes positive whilst the reading electrodes are again blocked and the charges are brought beneath the electrodes of the central row are $R_1$ to $R_4$, electrodes $GT_1$+, $GT_2$−, $GT_3$+, $GT_4$− remaining positive.

At $t_3$, it is the electrodes $GT_1$+, $GT_2$−, $GT_3$−, $GT_4$+ which are made conductive. The charges are then passed to electrodes $L_1$+, $L_2$+, $L_3$− and $L_4$− and the third component $Y_3=X_1+X_2-X_3-X_4$ is obtained. The charges then return beneath electrodes $R_1$ to $R_4$ when the latter are again positively polarized and when the reading electrodes are brought to earth.

At $t_4$, the electrodes $GT_1+$, $GT_2-$, $GT_3-$, $GT_4+$ are made conductive and the others $GT_i$ are blocked. Then, $\phi+$ and $\phi-$ become positive and $\phi_1$ is brought to earth. This gives $Y_4=X_1-X_2-X_3+X_4$, i.e. the fourth positive component. The charges are then passed beneath $R_1$ to $R_4$.

At time $t_5$, the grids $GTS_1$ to $GTS_4$ which up to then were blocked, are made conductive by signal $\phi GTS$, whilst $GT_i+$ and $GT_i-$ are blocked. The charges are passed to the output diodes $DS_{3-4}$ and $DS_{1-2}$ where there are dissipated. At the same time, grid $GTh+$, which remains blocked from the end of $t_1$, is made conductive and the following group of four input samples is passed beneath the reading electrodes $L_1+$, $L_2+$, $L_3+$, $L_4+$. The calculation of the four new components can then take place in the manner described hereinbefore. It was assumed in these devices that the upper electrodes were connected to the same input of differential reader 104 and the lower electrodes to the other input, however, this is not necessary. In the device described hereinbefore, it would also in fact be possible to connect the upper electrodes 1 and 3 to the positive input and electrodes 2 and 4 to the negative input. The first components obtained would then be $+X_1$, $-X_2$, $+X_3$, $-X_4$, provided that the transfer grids GTi were controlled in order to obtain the desired components in the sought order. In all cases, the electrodes having the same symbol are respectively connected to the inputs of opposite sign of the differential reader.

Such a device functions permanently because, for as long as the calculation is carried out for a group of four samples $X_1$ to $X_4$, $GTh+$ is blocked and the upper delay line LRh can receive the four following samples $X_5$ to $X_8$, which will be used for the following transform calculation cycle.

As indicated hereinbefore, the lower delay line LRb is used for balancing the polarization charges. At time $t_1$ of the calculation of the first coefficient, when $GTh+$ is unblocked, the same applies for $GTb-$. The charges of the corresponding line are then introduced beneath the negative reading electrodes $L_1-$ to $L_4-$ and the balance is reestablished for the calculation of the first coefficient.

After time $t_1$, the grids $GTb-$ remain conductive, whilst $GT_i-$ are blocked. The charges then return into delay line LRb. The charges are then displaced towards the output diode DSb where they are dissipated. This compensation process is repeated for each calculation of a new component $Y_1$.

Figure 11:
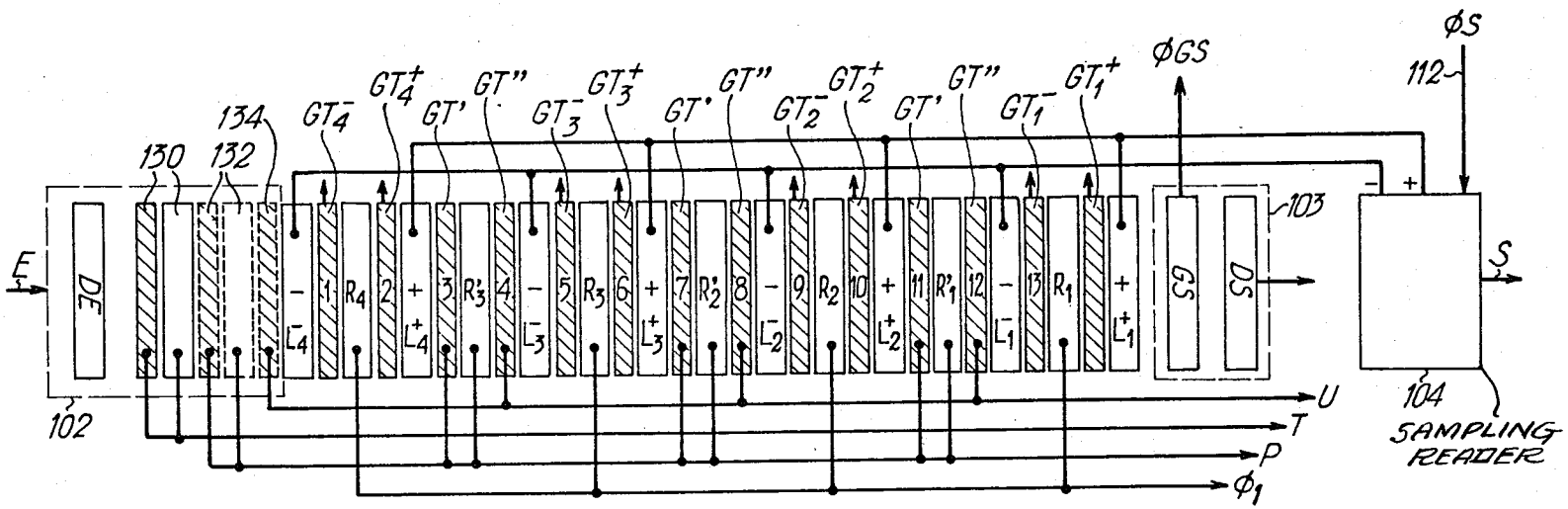
FIG. 11 an embodiment of a transformer with aligned electrodes.

The variants described hereinbefore have the disadvantage of requiring charge transfers in two orthogonal directions. Thus, they lead to devices in which the electrodes are virtually square, which leads to a mediocre compromise between the transform calculating rate and the signal-to-noise ratio. A better compromise can be obtained if the transfer is unidirectional, because the transformer can then comprise rectangular electrodes having a small dimension in the propagation direction (hence a high operating speed) and a larger dimension in the orthogonal direction (hence a better signal-to-noise ratio). Such a device is shown in FIG. 11 and the corresponding time diagram is given in FIG. 12.

The device comprises four rest electrodes $R_1$ to $R_4$, each being associated with a positive reading electrode $L_1+$ to $L_4+$ positioned downstream and a negative reading electrode $L_1-$ to $L_4-$ positioned upstream with respect to the charge flow direction. The rest electrodes are separated from their respective reading electrodes by transfer grids $GT_1+$ to $GT_4+$ and $GT_1-$ to $GT_4-$. The device then also comprises interposed electrodes $R_1'$, $R_2'$ and $R_3'$ arranged between the positive and negative reading electrodes and separated therefrom by upstream and downstream transfer grids GT' and GT'' respectively. The input circuit 102 is located at the upstream end of the device and comprises an input diode DE, a first electrode 130 (with two levels) controlled by a signal T, a second electrode 130 (also with two levels) controlled by a signal P and finally electrode 134 controlled by a signal U. At the downstream end, the output circuit 103 comprises an output grid GS, controlled by a signal $\phi GS$ and an output diode DS positioned at the downstream end.

Figure 12:
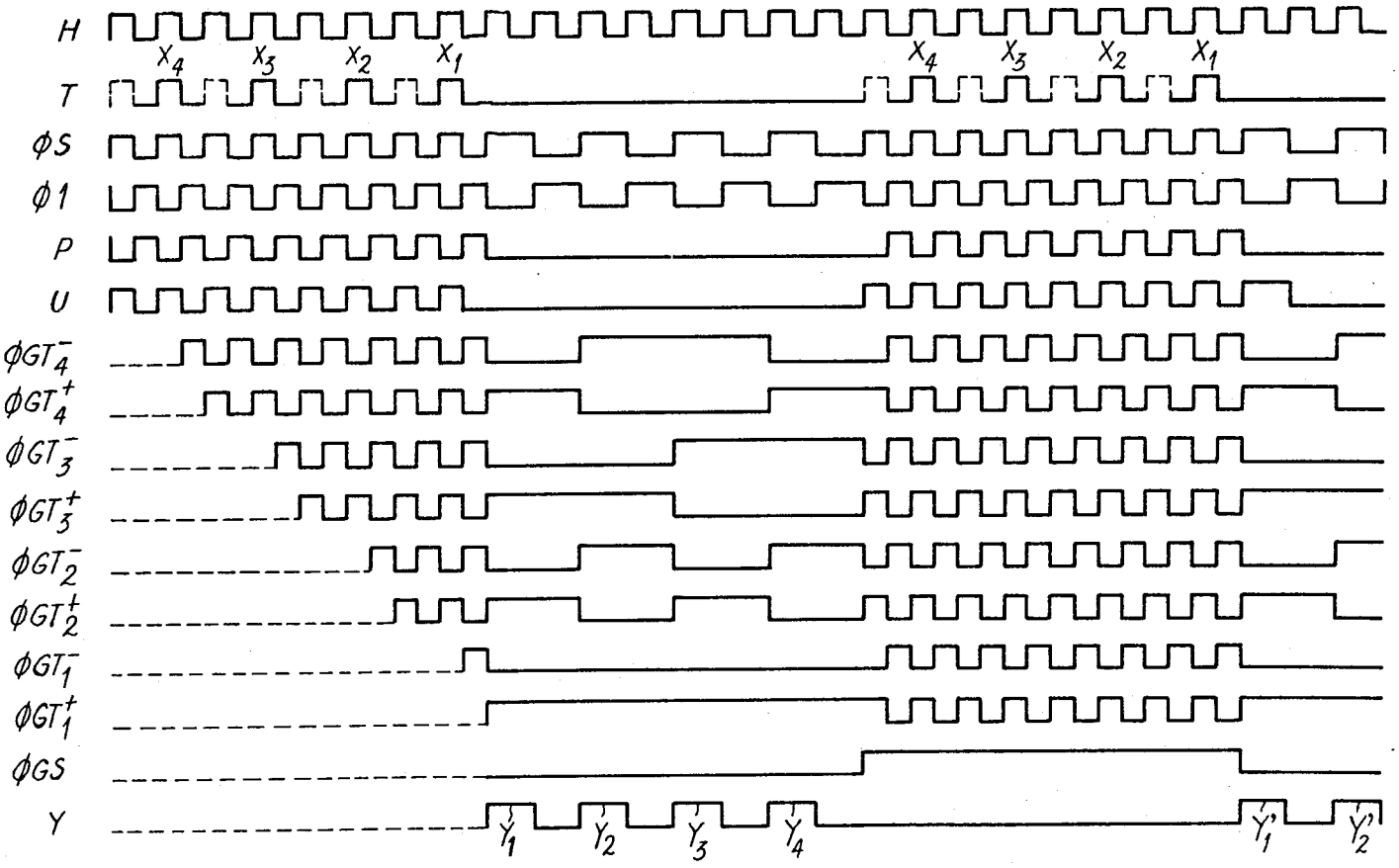
FIG. 12 a chronogram illustrating the operation of the transformer of FIG. 11.

The rest electrodes $R_1$ to $R_4$ are controlled by signal $\phi_1$ and the interposed electrodes $R_1'$ to $R_3'$ by signal P. The transfer electrode GT' positioned upstream of the interposed electrodes are controlled by signal P, whilst the transfer electrodes GT'' positioned downstream are controlled by a signal U. In the chronogram of FIG. 12, signal H is a clock signal with twice the frequency of the sampling frequency.

This device functions in the following way. The input of the samples is controlled by electrode 130 and signal T. The device functions in two periods. Firstly, the samples $X_1$,$X_2$,$X_3$ and $X_4$ are introduced beneath electrodes $R_1$,$R_2$,$R_3$,$R_4$ and the device behaves like a delay line. For this purpose, the signals $\phi S$, U, $GT_i+$ have the same phase, which is opposite to that of the signal $\phi_1$, P, $GT_i-$. Just before the time of obtaining sample $Y_1$ (last line Y of the chronogram) the samples are in place beneath electrodes $R_i$.

Signals T, P and U are then kept at earth, which prevents the displacement of samples in the line without the time of calculating components $Y_1$ to $Y_4$. As from this time, the operating speed of the device is halved and corresponds to a sampling frequency which is half the clock frequency. This is the second part of the operating cycle.

Grids $GT_1+$, $GT_2+$, $GT_3+$, $GT_4+$ are firstly made conductive, whilst grids $GT_1-$,$GT_2-$,$GT_3-$,$GT_4-$ are blocked and electrodes $R_i$ brought to earth. The charges then all migrate between the positive reading electrodes $L_i+$. $\phi S$ is made positive and the first component $Y_1$ of the transform is obtained. The voltages $\phi_1$ and $\phi S$ are then reversed and the charges return beneath the rest electrodes $R_i$.

In the following period, the electrodes $GT_1+$, $GT_2-$, $GT_3+$, $GT_4-$ are made conductive, the other transfer grids being blocked, so that $\phi_1$ and $\phi S$ are reversed again and the charges are passed beneath the reading electrodes corresponding to the conductive grids. The second component $Y_2$ of the transform is obtained. $\phi_1$ is then polarized and $\phi S$ brought to earth and the charges again pass beneath the rest electrodes $R_i$.

During the following period, it is the transfer electrodes $GT_1+$, $GT_2-$, $GT_3-$, $GT_4+$ which are made conductive, whilst the other transfer electrodes are blocked. When $\phi S$ and $\phi_1$ change polarity, the third component $Y_3$ of the transform is obtained at the output of the reading circuit. The charges are then returned beneath the rest electrodes, which become positive, whilst $\phi S$ is brought to earth.

Finally and in the same way, the transfer electrodes $GT_1+$, $GT_2-$, $GT_3-$, $GT_4+$ are made conductive whilst $\phi S$ becomes positive and $\phi_1$ drops to zero again.

This gives the four component $Y_4$ of the transform. The signals $\phi_1$ and $\phi S$ are then reversed and the charges are returned beneath the rest electrodes. As from this time, the device starts to work again as a delay line and four new samples are taken, whilst the charge groups which have been processed are ejected to the dissipating diode DS across the output grid GS, which becomes conductive due to $\phi GS$ which has become positive.

In the case where the input signal is polarized for the reasons indicated hereinbefore the compensation of the polarization charges can be obtained if, in addition to the samples which are introduced beneath electrodes $R_1$ to $R_4$, charges corresponding to the polarization are introduced beneath the negative reading electrodes by interposed electrodes R'. This is possible by applying the polarization signal to the input circuit for the times corresponding to the dotted lines in FIG. 10 (control T).

The device described is composed of approximately $[(2\times4\times N)]-2$ electrodes, N being the number of processed samples. On counting all the electrodes of the device, which may or may not be active and of the first or second levels in the case of a device with two phases and two electrode elevels, this number of electrodes is 30 in the case of a four-point transformer, i.e. working on groups of 4 samples.

It can be seen that the aforementioned device processes alternate groups of N samples. Two identical devices operating alternately must therefore be used for continuous operation.

Figure 13:
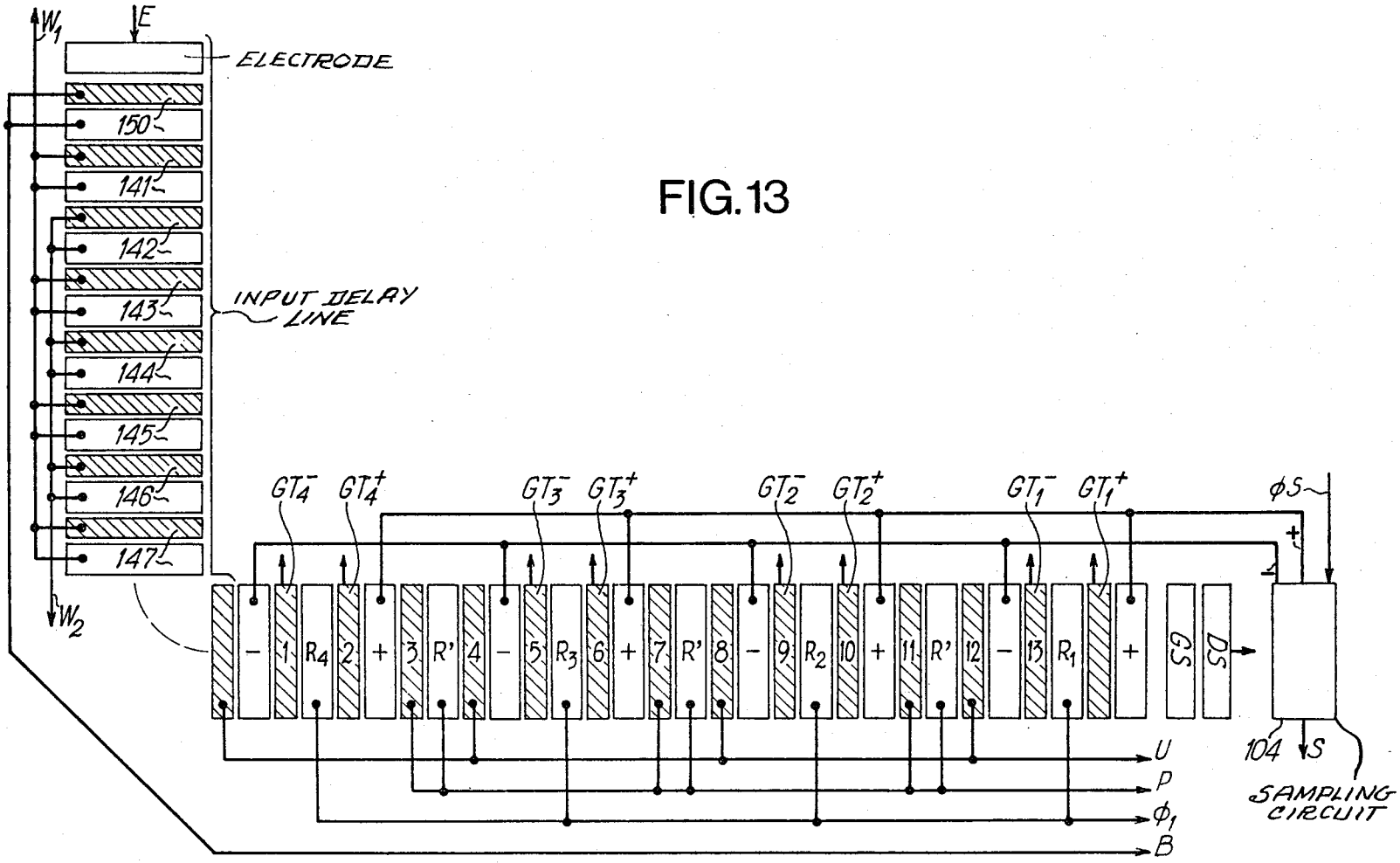
FIG. 13 another embodiment of a transformer with aligned electrodes.
Figure 14:
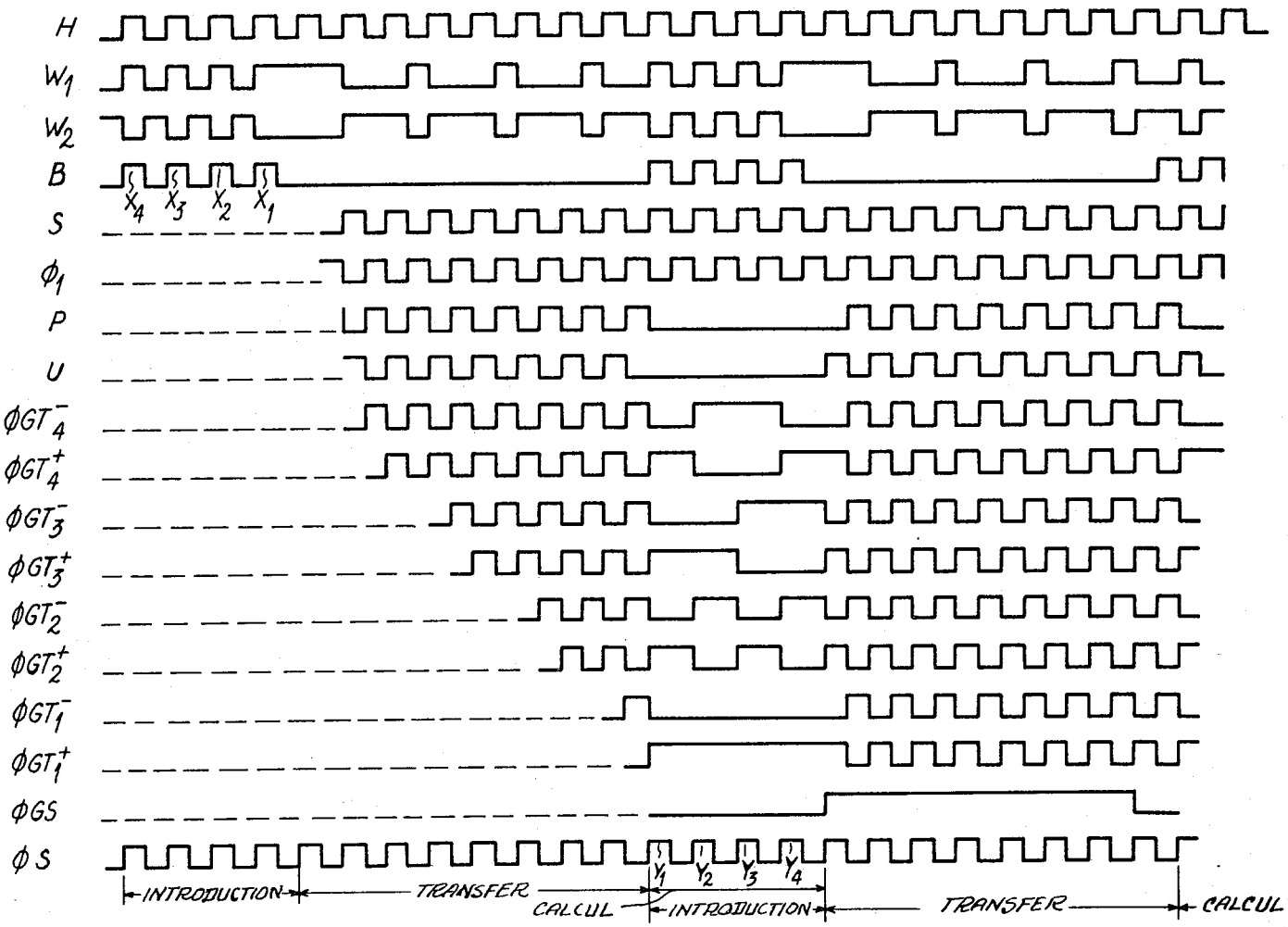
FIG. 14 a chronogram illustrating the operation of the device of FIG. 13.

The variant described hereinbefore is of interest, but has the disadvantage of requiring a clock frequency which is twice as high as the sampling frequency. A device which does not have the above disadvantage, because it operates at the sampling frequency, is shown in FIG. 13, the corresponding time diagram being given in FIG. 14.

The part of the device used for performing the Hadamard transformation is identical to that of FIG. 11, but it is preceded by an input delay line LRE. This line comprises seven electrodes with two levels 141 to 147, electrodes 141, 143, 145 and 147 being controlled by a signal $W_1$ and electrodes 142, 144, 146 by a signal $W_2$. An electrode 150, controlled by a signal B precedes the assembly. It is itself preceded by an input diode BE.

This device functions in the following way. The samples are introduced and displaced at the sampling frequency. The clock frequency, which times the delay line remains equal to the said sampling frequency. After 4 clock pulses, signal B controlling the input electrode 150 passes to zero, which closes the access to the following samples. The groups of charges introduced into the delay line LRE are then passed to the processing device at half the frequency. The control frequency of the delay line (signals $W_1$ and $W_2$) drops to half the sampling frequency whilst the line is discharged towards the processing device. Finally, the transform is calculated in the manner described hereinbefore. During this calculation it is possible to recharge the delay line with a new group of samples by bringing signal B to a positive value four times.

This variant makes it possible to process one group of samples out of every three. It therefore requires three identical arrangements operating alternately for continuous processing. Each device has a number of electrodes equal to the aforementioned device, i.e. $[(2\times4\times N)]-2$, to which is added the number of electrodes corresponding to the input delay line, i.e. $4\times N$ or in all $[(3\times4\times N)]-2$. For four samples, this number is equal to 46, for eight samples to 94 and for sixteen samples to 190.

The balancing of this device is the same as that described with reference to FIG. 11.

As indicated hereinbefore, it is possible on the basis of a transformer functioning with N samples, to provide a transformer functioning with 2N samples. It will now be described how it is possible to pass from a transformation of order M to a transformation of order $M\times N$.

Figure 15:
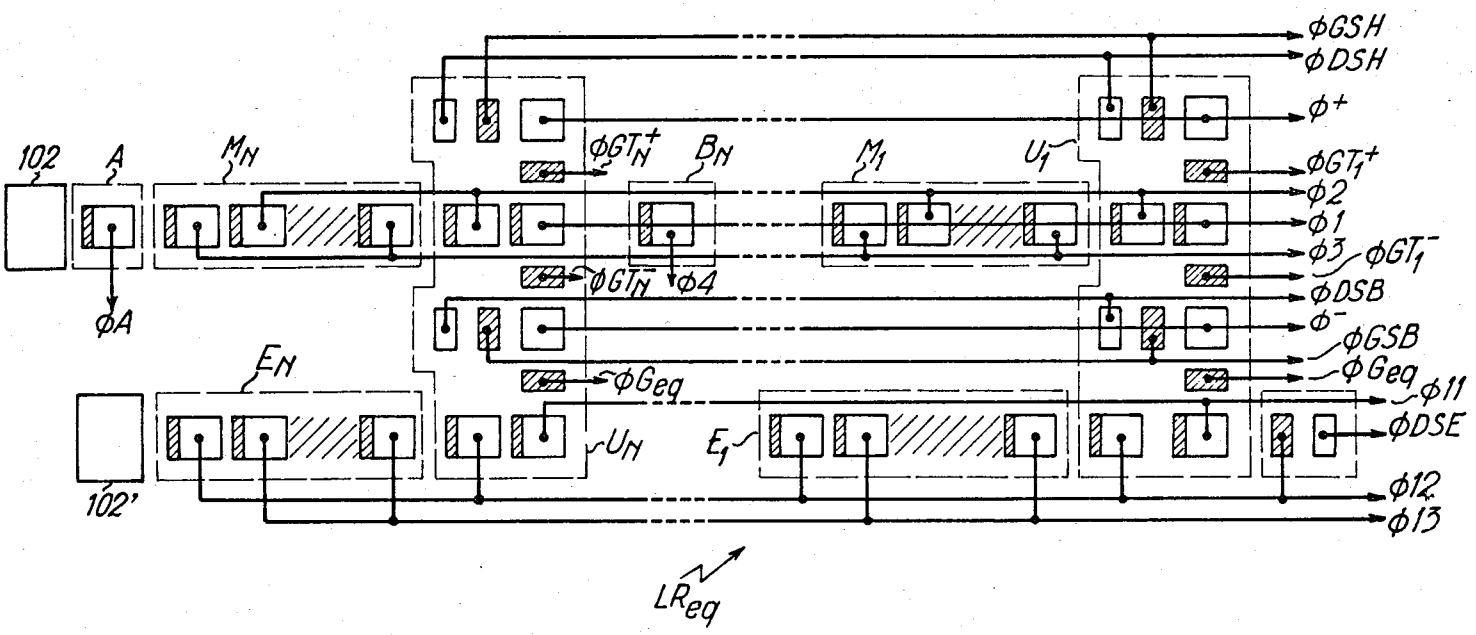
FIG. 15 a circuit making it possible to pass from a transformer with N points to a transformer with M×N points.

A transformer with M points supplies sequences of M samples. A device must be designed to perform a calculation equivalent to that which will be made by an N point transformer on these samples on N samples of the same rank (between 1 and M). The transformer in question is whon in FIG. 15. It comprises N identical processing cells $U_i$, i of 1 to N having the same construction as the transformer of FIG. 4.

These samples of different ranks are stored in cells $M_i$ of $2M-3$ electrodes and the balancing samples in cells $E_i$ of $2M-2$ electrodes. Each cell $U_i$ is followed by a blocking electrode $B_i$, with the exception of the first $U_i$ which does not need it, because it is located at the end of a row. The cells $M_i$, $U_i$ and $B_i$ form an upper delay line controlled by signals $\phi_1$, $\phi_2''$, $\phi_3$, $\phi_4$ in which are stored the $M\times N$ samples to be processed. The input of this line is controlled by an electrode A controlled by a signal $\phi A$ and preceded by the input circuit 102. The cells $E_i$ and $U_i$ form a balancing delay line $LR_{eq}$ supplied by an input circuit 102' and terminated by a dissipation diode DSE.

Figure 16:
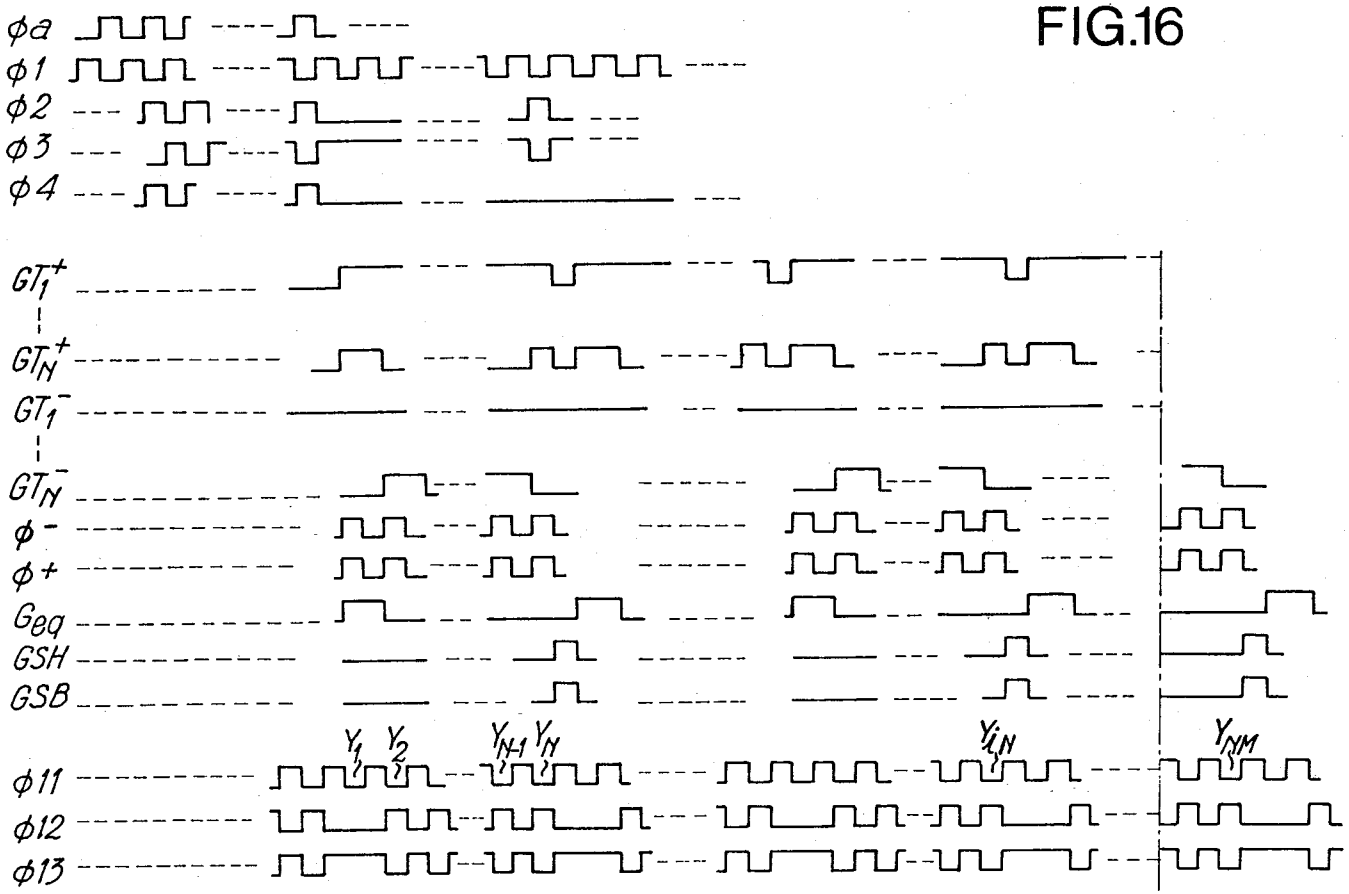
FIG. 16 a chronogram illustrating the operation of the device of FIG. 15.

The time diagram illustrating the operation of this device is given in FIG. 16 (case where N is even) operation is broken down into two parts.

In a first part, by the reverse action of $\phi_1$, $\phi_2$ on the one hand and $\phi_3$, $\phi_4$ on the other, the $M\times N$ samples to be processed are introduced into the upper line by $M\times N$ clock periods and by the reverse action of $\phi_{11}$, $\phi_{13}$ on the one hand and $\phi_{12}$ on the other. The balancing samples are introduced into the lower line.

At the end of this charging period, the samples of rank 1 (obtained by a M point transformer) are respectively located beneath electrodes 1, $2M+1$ . . . $2N\times M+1$. The calculation to be performed on these samples is the same as that described with reference to the transformer of FIG. 4. However, at the time of $N^{th}$ calculation, $\phi_2$ is made positive and $\phi_3$ negative. The higher rank samples pass at the following incident (by reversal of controls) beneath the electrodes connected to $\phi_1$. The samples of the second rank are located beneath electrodes 1, $2M+1$, etc. and the same calculation can be repeated on these new samples. The same operations are repeated for the samples of the following rank 3, 4 . . . M. After the final calculation, the grid A can again be unblocked and the following $N\times M$ samples can be introduced in order to obtain a new transform and so on.

The charging and calculating operations cannot be performed simultaneously in the same device with this solution, so that it is necessary to use two alternately operating devices for forming a transformer which can operate continuously. In the same way as described relative to FIG. 6, these two transformers can be located on either side of the same input or balancing circuits.

Figure 17:
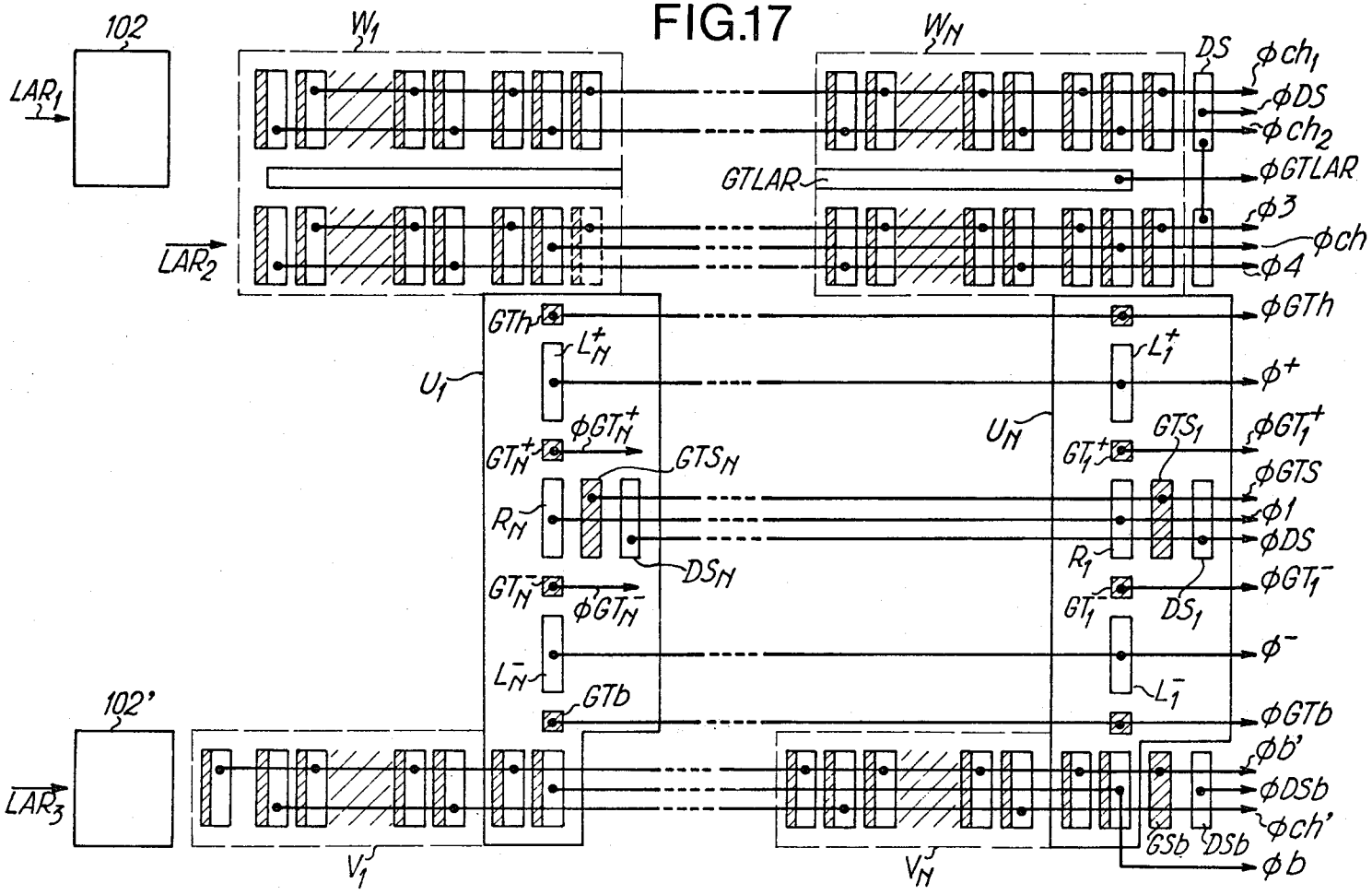
FIG. 17 another embodiment of a circuit making it possible to pass from a transformer with M points to a transformer with M×N points.

Another solution for passing from an M point transformer to an $M\times N$ point transformer is shown in FIG. 17. The device comprises M identical processing cells $U_i$ (i from 1 to N) identical to those of FIG. 9. These cells are preceded in their lower part by cells $V_i$ formed from M−1 pairs of electrodes serving to carry the balancing samples supplied by an input circle 1 or 102'. The line is terminated by an output circuit incorporating a grid GSb and a diode DSb. The groups of cells $V_i$ forms a delay line $LAR_3$ controlled by signals $\phi_b$; $\phi_b'$ and $\phi ch'$.

The samples corresponding to the components given by a preceding M point transformer are introduced by means of two upper delay lines $LAR_1$ and $LAR_2$ formed by cells $W_i$ (i from 1 to N) having two superimposed rows of M pairs of electrodes. Line $LAR_1$ is controlled by signals $\phi ch_1$ and $\phi ch_2$ and line $LAR_2$ by signals $\phi_3$ and $\phi_4$. The two lines $LAR_1$ and $LAR_2$ are separated by a GTLAR grid controlled by a $\phi$GTLAR signal. The final electrode of the lower row of cell $W_i$ shown in dotted line form can be eliminated, except in cell WN. At this point, the channel of the CCD can be interrupted. Line $LAR_1$ is preceded by an input circuit 102 and is terminated by a dissipating diode DS.

Each cell $U_i$ comprises a central electrode $R_i$ controlled by $\phi_1$, followed by an output grid $GTS_i$ controlled by $\phi$GTS and controlling the access of a diode $DS_i$ controlled by $\phi$DS. This grid is surrounded by two transfer grids $GT_i^+$ and $GT_i^-$ controlling the access to the reading electrodes $L_i^+$ and $L_i^-$. The charges to be processed are introduced via an upper grid GTh and the balancing samples from the lower electrodes have access to grids $L^-$ by grids GTb.

Figure 18:
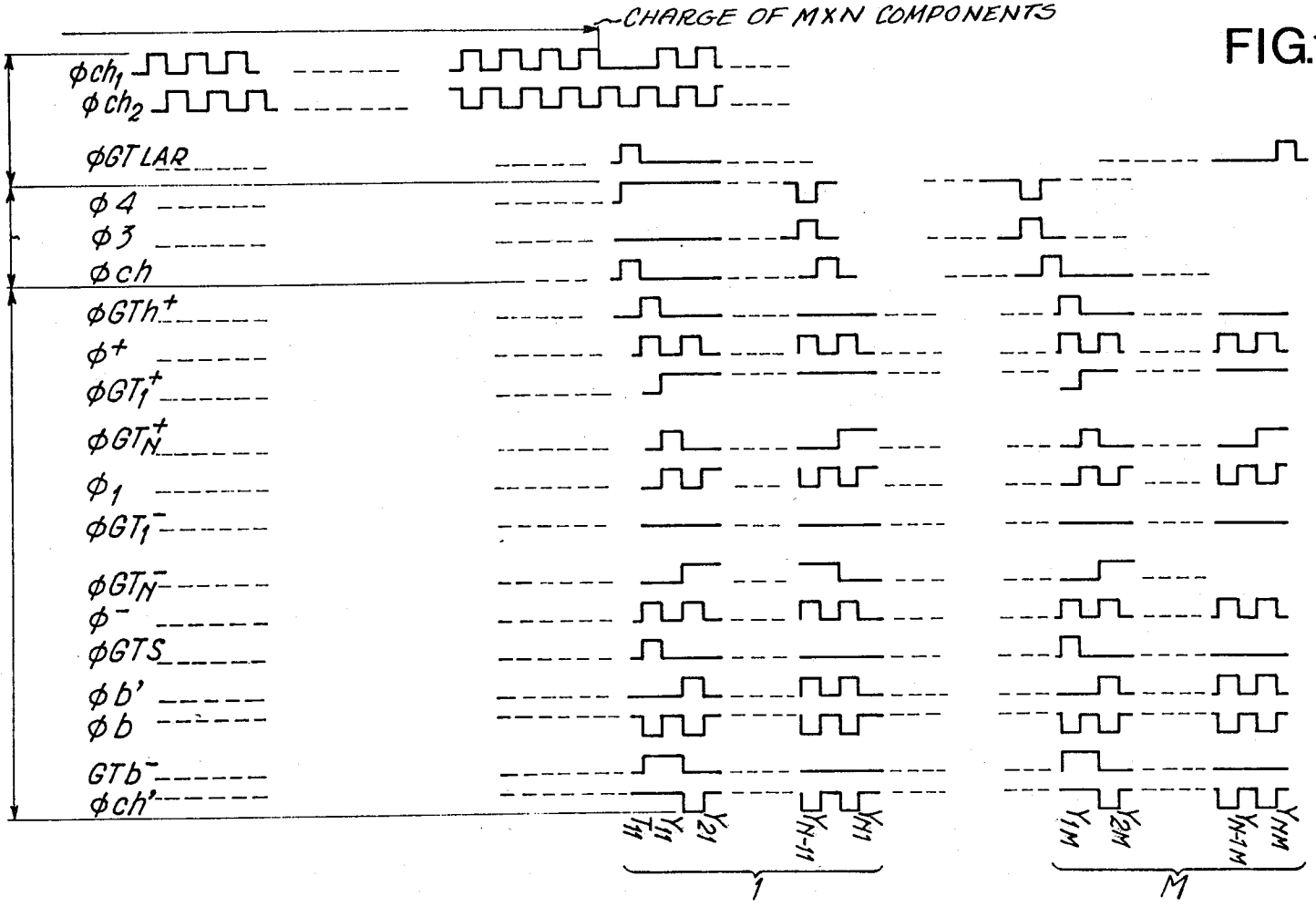
FIG. 18 a chronogram illustrating the operation of the device of FIG. 17.

The operation of this device is illustrated on the chronogram of FIG. 18. A first charging phase takes place in lines $LAR_1$ and $LAR_2$. Initially, the M×N samples to be processed are introduced into $LAR_1$ by means of controls $\phi ch_1$ and $\phi ch_2$ which operate in opposition. After M×N pulses of $\phi ch_2$, $\phi ch_1$ remains blocked and $\phi ch_2$ also becomes blocked. At the same time, $\phi$GTLAR becomes positive, which transfers all the samples into line $LAR_2$ (time $T_{11}$). $\phi$ch and $\phi_4$ are then positive. Line $LAR_1$ can then start to charge by the M×N following samples. $\phi ch_1$ starts to become polarized again in opposition with $\phi ch_2$.

During this time, the lower delay line $LAR_3$ receives balancing samples by the combined action of $\phi_b$, $\phi_{b'}$ and $\phi ch'$. At time $T_{11}$, there are balancing samples beneath each of the electrodes controlled by $\phi_b$.

At the time following $T_{11}$, the actual processing starts through the introduction of N components of rank 1 (in the first transform) beneath electrode $EL_i^+$.

By making $\phi$GTh and $\phi^+$ positive in a symmetrical manner, $\phi^-$ and $\phi$GTb becoming positive, the balancing charges penetrate beneath $L_i^-$. At the same time, $\phi$GTS becomes positive, which displaces the charges of electrodes connected to $\phi_1$ to diodes DS. Thus, the first component $Y_{11}$ of the total M×N point transform is obtained. Processing continues in the same way as described relative to FIG. 10 (case where N would be equal to 4; if N exceeds 4 it is sufficient to control the $GT_i^+$ electrodes in accordance with the signs of the coefficients of the corresponding Hadamard matrix and the $GT_i^-$ electrodes in phase opposition.

In FIG. 18, the case where N is an integral multiple of 4 is considered. However, at the time when component $YN_1$ is obtained, it is necessary to advance the components of the following rank into line $LAR_2$ by making $\phi_4$ blocked which remained positive from $Y_1$ to $YN_1$. Signal $\phi_3$ symmetrically changes state. At the following time $YN_1$, $\phi_3$ and $\phi_4$ change state, whilst $\phi$ch becomes positive. The samples of rank 2 are then ready to be transferred to cells $U_i$ and can undergo the same processing. It is then the turn of the following components up to rank M. The N×M new components which, throughout this processing operation, have filled line $LAR_1$ can then be considered and so on.

Figure 19:
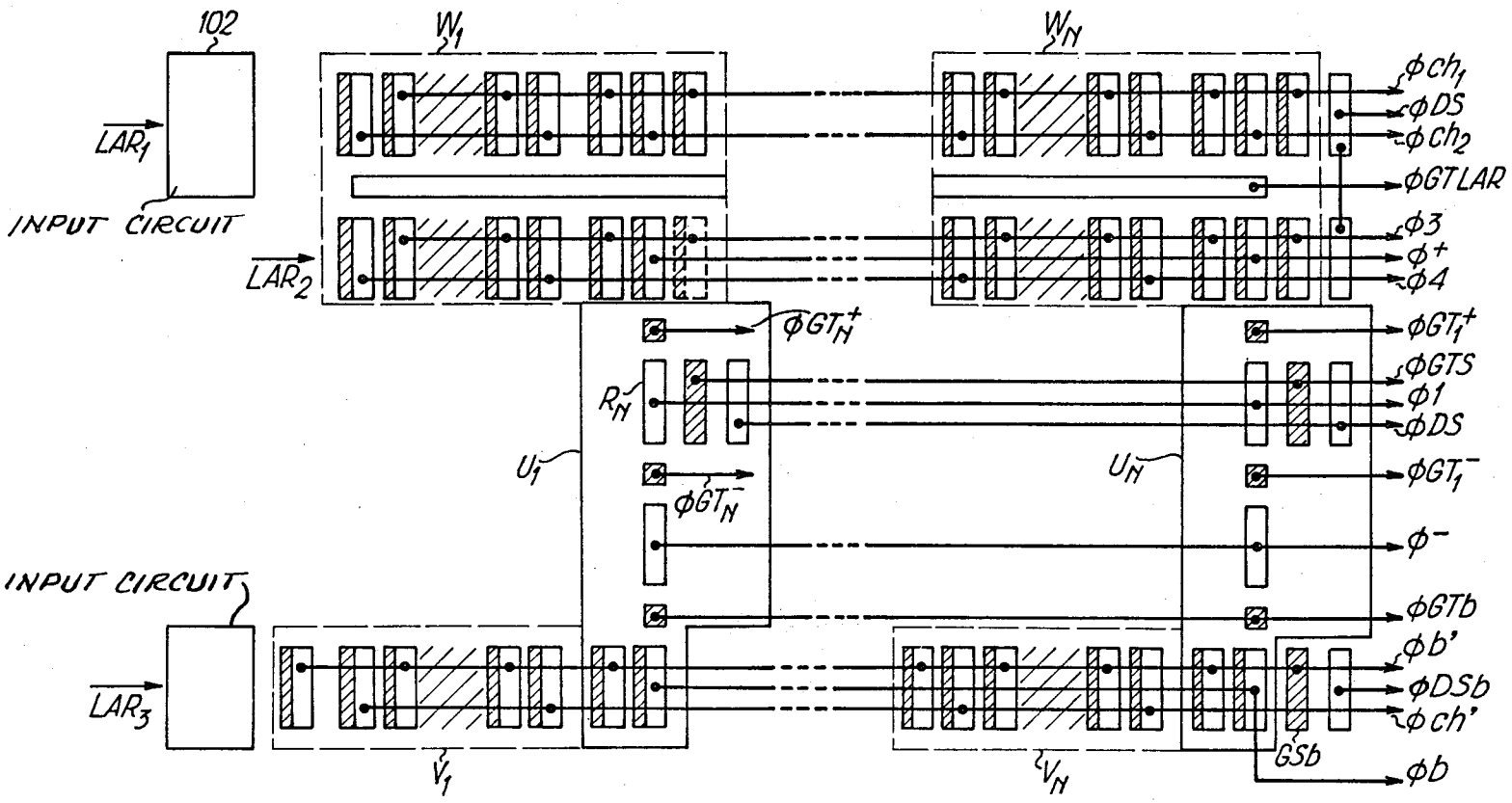
FIG. 19 another embodiment of a transformer with M→M×N points, similar to that referred to hereinbefore.

FIG. 19 shows a slightly different solution, but which is slightly more compact, line $LAR_2$ being superimposed on the reading electrode $L_i^+$. Under these conditions, $\phi$ch and $\phi^+$ coincide and $\phi$GTh is obviously eliminated. The operation is immediately apparent from what has been stated hereinbefore. In the same way, it is possible to deduce from the devices of FIGS. 11 and 13 solutions where the transfer of the charges is unidirectional (and consequently does not take place in two orthogonal directions) transformers using the same calculating cell and making it possible to pass from a transform of dimension N to a transform of dimensions N×M.

Whatever the variant used, the Hadamard transformers according to the invention offer an important advantage not encountered with similar prior art transformers. This advantage is their compatibility with the CTD picture analysers and this point will now be defined.

It is known that the CTD picture analysers comprise a matrix of photosensitive cells organised in the same way as charge transfer devices with, at the output, a shift register and a charge detector circuit.

Figure 20:
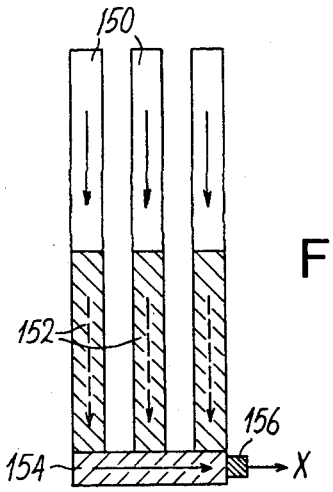
FIG. 20 diagrammatically, a picture converter using charge transfer devices.

FIG. 20 diagrammatically shows the construction of such a device using a first zone formed from columns 150 which constitutes a photosensitive area and a second zone formed by columns 152 arranged in the extension of the first. However, the latter are not photosensitive. A shift register 154 is positioned in the lower part of columns 152. These three assemblies 150, 152 and 154 are constituted by CTD. The device is completed by a charge detection circuit 156, which supplies a voltage which is proportional to the charges received.

Such a device functions in the following way. The image to be converted is projected onto the area formed by columns 150. Minority carriers are formed under the action of this photon excitation and accumulate beneath each of the electrodes in proportion to the light intensity received. This "electronic image" is then rapidly transferred into the buffer zone formed by columns 152 and the first zone reassumes its photodetection function. The charges stored in the buffer zone are then transferred downwards line by line into register 154. The latter is then emptied from left to right into the discharge device 156, which supplies samples, each representing a point of the analysed picture. When a complete frame of the picture has in this way been expelled from the buffer zone, a new frame is introduced into it and the process recommences.

A more detailed description of these devices and other constructional variants appears in pp. 142 to 200 of the aforementioned work.

The Hadamard transformers according to the invention and in particular those of FIGS. 7 and 9 having only a single input and which can work on a continuous sequence of samples are combined particularly easily with picture analysers of this type. Thus, it is merely necessary for the output line of such an analyser to be followed by the transformer according to the invention, the input circuit of the latter naturally being eliminated, because the signal to be processed is given directly by the picture analyser in the form of groups of charges.

The integration of a Hadamard transformer according to the invention into a picture analyser is simple from the technological standpoint because, in both cases, they are charge transfer devices requiring the same components and the same materials. The assembly then constitutes a monolithic device directly supplying the Hadamard transform of the analysed picture or sub-pictures, whereby the latter can be portions of the same line or rectangular sub-pictures as a function of the order in which the points of the picture are transferred to the output register of the analyser.

The invention is obviously not limited to the use of charge-coupled devices (CCD) and instead extends to all types of charge transfer devices, including so-called bucket-brigade devices (BBD), as described in the aforementioned work.

What is claimed is:

1. A Hadamard transformer which makes a group of N transformed samples $Y_1 \ldots Y_j \ldots Y_N$ correspond to a group of given samples $X_1 \ldots Xi \ldots X_N$, each having transformed samples being defined by a weighted sum of N given samples, the weighting coefficients being equal to +1 and −1, wherein it comprises:

(A) a charge transfer device incorporating:

(a) N rest electrodes $R_1 \ldots R_i \ldots R_N$ preceded by N transfer electrodes $R_1' \ldots R_i' \ldots R_N'$ (b) 2N reading electrodes, which rest electrodes $R_i$ being positioned between a first reading electrode $L_i+$ and a second reading electrode $L_i-$;

(c) 2N transfer electrodes $GT_i+$ and $GT_i-$ positioned between each rest electrode $R_i$ and the associated reading electrodes $L_i+$ and $L_i-$;

(B) an input circuit able to convert the samples $X_1 \ldots X_i \ldots X_N$ into proportional charge groups;

(C) a means for injecting these charge groups beneath the rest electrodes in such a way that the charges corresponding to the samples $X_1 \ldots X_i \ldots X_N$ are respectively positioned beneath the electrodes $R_1 \ldots R_i \ldots R_N$;

(D) a differential charge reader with two inputs, one positive and the other negative, the reading electrode $L_i+$ being connected to the positive input and the reading electrode $L_i-$ to the negative input and to an output supplying the transformed samples $Y_1 \ldots Y_j \ldots Y_N$;

(E) a control circuit having a first output connection connected to the rest electrodes $R_i$ and carrying a signal $\phi_1$ and a second output connection connected to the transfer electrodes $R_i$ and carrying a signal $\phi_2$ in phase opposition to $\phi_1$, a first group of N output connections connected to the N transfer electrodes $GT_i+$ and carrying signals $\phi GT_i+$ and a second group of N output connections connected to the N transfer electrode $GT_i-$ and carrying signals $\phi GT_i-$, said signals $\phi_1$, $\phi_2$, $\phi GT_i+$ and $\phi GT_i-$ being able to firstly control the transfer of charges positioned beneath each rest electrode to one of the two associated reading electrodes, then the return of these charges to said rest electrodes, this taking place N times to obtain the N transformed samples.

2. A transformer according to claim 1, wherein the rest electrodes $R_1$ are aligned and are preceded by transfer electrodes $R_i'$.

3. A Hadamard transformer according to claim 2, wherein the charge transfer device also comprises, associated with the group of electrodes $L_i+$ and $L_i-$, two transfer grids respectively GS+ and GS− and two output diodes respectively DS+ and DS− for discharging the charges after obtaining N transformed samples.

4. A Hadamard transformer, wherein it comprises two identical transformers Tg and Td according to claim 3, said transformers having a common input circuit which receives the uninterrupted sequence of input samples and passes the groups of N input samples alternately to one or other of the two transformers and having a common output circuit, which supplies the uninterrupted sequence of transformed samples.

5. A Hadamard transformer, wherein it comprises two identical transformers Tb and Th according to claim 1 having a common input circuit and common output circuit, said transformers being positioned on either side of a central row of 2N-1 electrodes forming a delay line, the input circuit being located at the input of said delay line, and wherein it comprises two transfer electrodes, GTh and GTb respectively connecting the two transformers to the electrodes of the central row and being controlled by signals respectively $\phi$GTh and $\phi$GTb able to totally transfer the N groups of charges filling the central row alternately to one or other of the transformers.

6. A Hadamard transformer according to claim 5, wherein each charge transfer device comprises along the reading electrodes facing the delay line a transfer grid GSh and GSb respectively and an output diode DSh and DSb respectively for the discharge of charges after reading the N transformed samples.

7. A Hadamard transformer according to claim 1, wherein one of the rows of reading electrodes is bordered by a row of 2N-1 electrodes forming a shift register, which is associated with an input circuit for the samples and which is separated from said row of reading electrodes by a row of transfer electrodes.

8. A Hadamard transformer according to claim 1, wherein the rest electrodes, reading electrodes and transfer electrodes are all aligned.

9. A Hadamard transformer according to claim 8, wherein it is preceded by an input delay line LRE able to receive the groups of N input samples.

10. A Hadamard transformer according to claim 1, wherein the charge transfer device is completed by balancing means.

11. A Hadamard transformer according to claim 10, wherein the balancing means comprises polarization means for the input signal in order to give it a given sign and electrodes able to introduce charges beneath the reading electrodes of the opposite sign.

12. A Hadamard transformer according to claim 11, wherein the balancing means comprise a delay line $LR_{eq}$ located along the reading electrode $L_i-$ and separated therefrom by grids $G_{eq}$.

13. A Hadamard transformer operating on sequences of M×N samples, wherein it comprises at least one delay line ($LAR_1$; $LAR_2$) for introducing M×N samples and a transformer according to claim 1, for processing N samples of the same rank between 1 and M.

14. A Hadamard transformer according to claim 1, wherein it is integrated into a picture analyser of the charge transfer type, the input circuit of the transformer being eliminated, its input being directly connected to the output of the picture analyser.

* * * * *